US008469751B2

(12) United States Patent
Oiri et al.

(10) Patent No.: US 8,469,751 B2
(45) Date of Patent: Jun. 25, 2013

(54) ELECTRICAL CONNECTOR AND HARNESS

(75) Inventors: Nobuyasu Oiri, Tokyo (JP); Masakazu Kuroiwa, Tokyo (JP); Yusuke Obata, Tokyo (JP); Yoshinobu Yamamoto, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 13/424,554

(22) Filed: Mar. 20, 2012

(65) Prior Publication Data

US 2012/0289090 A1 Nov. 15, 2012

(30) Foreign Application Priority Data

May 13, 2011 (JP) ..... 2011-108062

(51) Int. Cl.
*H01R 13/502* (2006.01)

(52) U.S. Cl.
USPC ..... 439/701

(58) Field of Classification Search
USPC ..... 439/625, 164, 884, 660, 378
See application file for complete search history.

(56) References Cited

U.S. PATENT DOCUMENTS

| | | | | |
|---|---|---|---|---|
| 2002/0039862 | A1* | 4/2002 | Nishide | 439/701 |
| 2008/0014777 | A1* | 1/2008 | Tan et al. | 439/164 |
| 2010/0099303 | A1* | 4/2010 | Maenhout et al. | 439/625 |
| 2011/0222819 | A1* | 9/2011 | Anderson et al. | 385/78 |
| 2011/0256753 | A1* | 10/2011 | Gulla | 439/378 |
| 2011/0287666 | A1* | 11/2011 | Nishi et al. | 439/660 |
| 2011/0315483 | A1* | 12/2011 | Griffiths et al. | 182/232 |

FOREIGN PATENT DOCUMENTS

JP 2000-268915 A 9/2000

* cited by examiner

*Primary Examiner* — Jean F Duverne
(74) *Attorney, Agent, or Firm* — Maier & Maier PLLC

(57) ABSTRACT

A waterproof connector includes a female contact, a housing, and a retainer. The housing includes a first inner wall surface, a second inner wall surface, a first engaging part, and a lance. The female contact includes a pressed surface that is pressed by the lance, and a first engaged part that is formed to protrude in a direction away from the pressed surface. A second engaging part is formed in the housing and a second engaged part that can be engaged with the second engaging part is formed in the female contact so that a second engagement between the housing and the female contact is achieved on a side opposite to the side of a first engagement between the first engaging part and the first engaged part with respect to a central axis of the female contact.

9 Claims, 28 Drawing Sheets

F

RELATED ART

ELECTRICAL CONNECTOR AND HARNESS

RELATED APPLICATIONS

This application claims priority under 35 U.S.C. §119 to Japanese Patent Application No.: 2011-108062, filed on May 13, 2011, the disclosure of which is incorporated by reference herein in its entirety.

BACKGROUND OF THE INVENTION

1. Field of the Invention

The present invention relates to an electrical connector and a harness.

2. Description of Related Art

As this type of technique, as shown in FIG. 22 of this application, Japanese Patent Application Publication No. 2000-268915 discloses a connector that includes a connector housing 100, a retainer 101, and a terminal fitting 102. A cavity 103 into which the terminal fitting 102 is inserted is formed in the connector housing 100. A cantilevered lance 104 is formed in the retainer 101. An engagement projection 104*a* that protrudes in the side of the cavity 103 is formed at the tip of the lance 104. When the terminal fitting 102 is inserted into the cavity 103 of the connector housing 100, the retainer 101 is retained in a half-locked position shown in FIG. 22 in advance in the connector housing 100. When the terminal fitting 102 is continuously inserted into the cavity 103, the tip of the terminal fitting 102 hits the engagement projection 104*a* of the lance 104, and the lance 104 temporarily deflected and deformed. When the terminal fitting 102 is continuously inserted into the cavity 103, the engagement projection 104*a* of the lance 104 engages with an engaging hole 102*a* of the terminal fitting 102 with elastic restoration of the lance 104, and the terminal fitting 102 is retained in the lance 104. After that, when the retainer 101 is pressed upward, the rear edge part of a box-shaped member 102*b* of the terminal fitting 102 engages with a locking step 105 on the upper surface of the cavity 103, whereby the terminal fitting 102 is locked in double, which exhibits great retaining force.

SUMMARY OF THE INVENTION

By the way, as shown in FIGS. 23 to 26, the present inventors have developed, prior to the present application, a connector 206 that primarily locks a contact 203 inserted into a cavity 201 of a housing 200 using a lance 205 before secondarily locking the contact 203 by a retainer 204 (see FIG. 26).

More specifically, the contact 203 is inserted into the cavity 201 in a direction More specifically, the contact 203 is inserted into the cavity 201 in a direction indicated by an arrow X in FIG. 23. Then, as shown in FIG. 24, the contact 203 elastically deforms the lance 205 formed in a cantilevered shape in the cavity 201 to push down the lance 205. When the contact 203 is further inserted into the cavity 201 in the direction indicated by the arrow X from the state shown in FIG. 24, a contact part 203*a* of the contact 203 moves beyond an engaging part 207 formed in the cavity 201. Then, as shown in FIG. 25, the contact 203 is pushed up in the direction indicated by an arrow Y due to self elastic restoration force of the lance 205. Then, the contact part 203*a* is engaged with the engaging part 207, thereby achieving a primary locked state. Then, as shown in FIGS. 25 and 26, when the retainer 204 is inserted into a gap space 208 between the contact part 203*a* and an inner wall surface 201*a* in the direction indicated by an arrow Z, the contact 203 is in a secondary locked state in the cavity 201 of the housing 200.

As described above, the connector 206 is configured to be able to achieve both of the primary locked state in which the contact 203 is locked in the housing 200 and the secondary locked state in which the contact 203 is firmly locked in the housing 200, thereby achieving excellent assembling workability of the connector 206.

However, a problem that the contact 203 is released from the housing 200 occurs in the actual manufacturing line from when the contact 203 is inserted into the cavity 201 of the housing 200 to when the retainer 204 is attached to the housing 200, or in other words, from when the engagement of the contact 203 with the housing 200 is in the primary locked state to when the primary locked state is switched to the secondary locked state. Such a problem occurs by the mechanisms shown in FIGS. 27 and 28. Specifically, when pull-out force F1 is acted on a cable 210 connected to the contact 203 in the primary locked state shown in FIG. 27, the contact 203 receives counter acting force F2 that is in balance with the pull-out force F1 from the engaging part 207. Note that the pull-out force F1 and the counter acting force F2 are not on the same line of action. Accordingly, the pull-out force F1 and the counter acting force F2 form couple of forces, resulting in generation of a moment M1 in the counterclockwise direction in the contact 203 as shown in FIG. 27. The generation of the moment M1 inclines the contact part 203*a* as shown in FIG. 28, which results in weak engagement relation between the contact part 203*a* of the contact 203 and the engaging part 207 of the housing 200. In some cases, the contact 203 is released from the housing 200.

In order to solve this problem, it may be possible to counteract the moment M1 by increasing the moment of inertia of area of the lance 205, for example. In order to increase the moment of inertia of area of the lance 205, it is efficient to increase the cross-sectional area of the lance 205, for example. However, it is impossible to use this method since it hardly satisfies the request for reduction in size of the connector 206 that has strongly been required.

An exemplary object of the present invention is to provide a technique to make the contact hardly released from the housing when the pull-out force is acted on the contact in the primary locked state.

An exemplary aspect of the present invention is an electrical connector formed as follows. Specifically, the electrical connector includes a contact, and a housing that includes a cavity into which the contact is able to be inserted. The housing includes a first inner wall surface that defines the cavity and is substantially parallel to a contact insertion direction which is a direction in which the contact is inserted into the cavity; a second inner wall surface that is opposed to the first inner wall surface; a first engaging part that is formed to protrude from the first inner wall surface toward the second inner wall surface; and a pressing piece that is formed in the second inner wall surface and presses the contact inserted into the cavity toward the first inner wall surface. The contact includes: a pressed surface that is pressed by the pressing piece; and a first engaged part that is formed to protrude in a direction away from the pressed surface. When the contact is inserted into the cavity and the first engaged part moves beyond the first engaging part, the contact moves toward the first inner wall surface due to pressing force by the pressing piece, and a primary locked state is achieved in which the first engaged part is engaged with the first engaging part. A second engaging part is formed in the housing and a second engaged part that is capable of being engaged with the second engaging part is formed in the contact so that a second engagement between the housing and the contact is achieved on a side opposite to the side of a first engagement between the first engaging part and the first engaged part with respect to a central axis of the contact.

Preferably, the second engaging part is formed in the pressing piece.

Preferably, the second engaged part is formed by forming a hole on the pressed surface or making a recess on the pressed surface.

Preferably, the second engagement is performed in a near side of the contact insertion direction compared with the first engagement.

Preferably, the pressing piece is formed in a cantilevered shape while being supported by the second inner wall surface. The second engaging part is formed in a free end of the pressing piece. An abutted part that contacts with the pressed surface of the contact in the primary locked state is formed between the free end and a fixed end of the pressing piece.

Preferably, an inclined surface is formed on a second engaged surface of the second engaged part with respect to the second engaging part, the inclined surface inclining so as to be away from the second engaging part toward the second inner wall surface.

Preferably, in the second engaging part, a second engaging part front end surface corresponding to the second engaged surface is formed in the second engaging part.

Preferably, the electrical connector further includes a retainer that prevents movement of the contact inserted into the cavity in a direction perpendicular to the contact insertion direction, in which by inserting the retainer between the contact and the second inner wall surface in the primary locked state, a secondary locked state is achieved in which the movement of the contact in the direction perpendicular to the contact insertion direction is prevented.

A harness is provided that includes an electric wire including a core wire including the contact attached thereto; and the electrical connector described above.

When the pull-out force which is the force to pull out the contact from the housing is acted on the contact in the primary locked state, a first moment due to the first engagement is generated in the contact. The first moment inclines the contact in the cavity to release the first engagement. On the other hand, according to the present invention, a second moment which is opposite to the first moment is generated due to the second engagement. Accordingly, in the primary locked state, when the pull-out force is acted on the contact, the contact is hardly inclined in the cavity and the first engagement is hardly released, thereby making the contact hardly released from the housing.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

First Exemplary Embodiment

Figure 1:
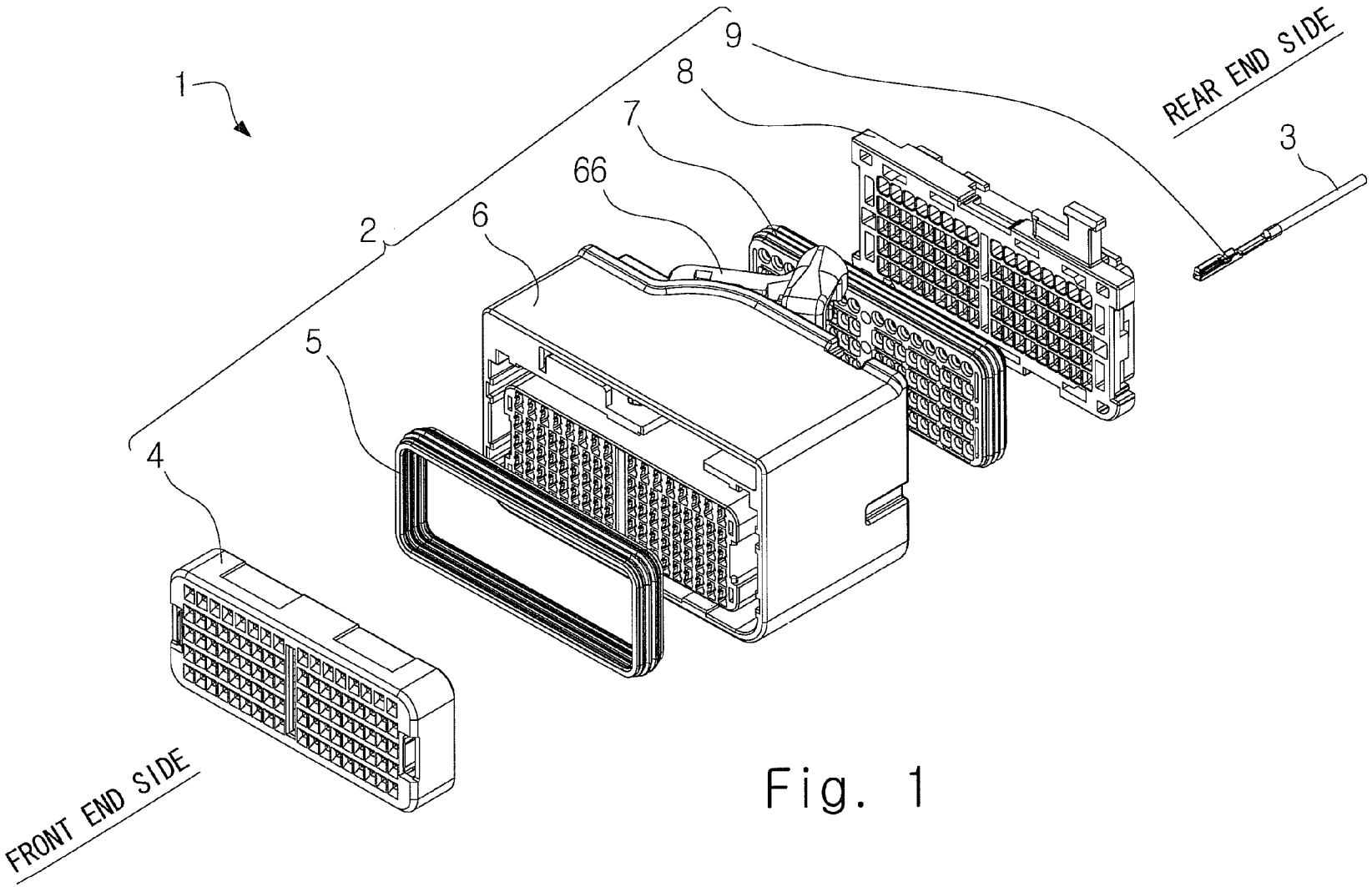
FIG. 1 is an exploded perspective view of an electrical connector (first exemplary embodiment)

As shown in FIG. 1, in a first exemplar embodiment, a harness 1 is used, for example, in wiring of electric systems in four-wheel vehicles or two-wheel vehicles. The harness 1 includes a waterproof connector 2 (electrical connector) and a plurality of electric wires 3.

(Waterproof Connector 2)

The waterproof connector 2 mainly includes a front retainer 4, a sealing member 5, a housing 6, a grommet 7, a rear cover 8, a plurality of female contacts 9 (contact), and a rotational lever 66 that rotates to connect the connector to a mating connector (not shown).

Figure 2:
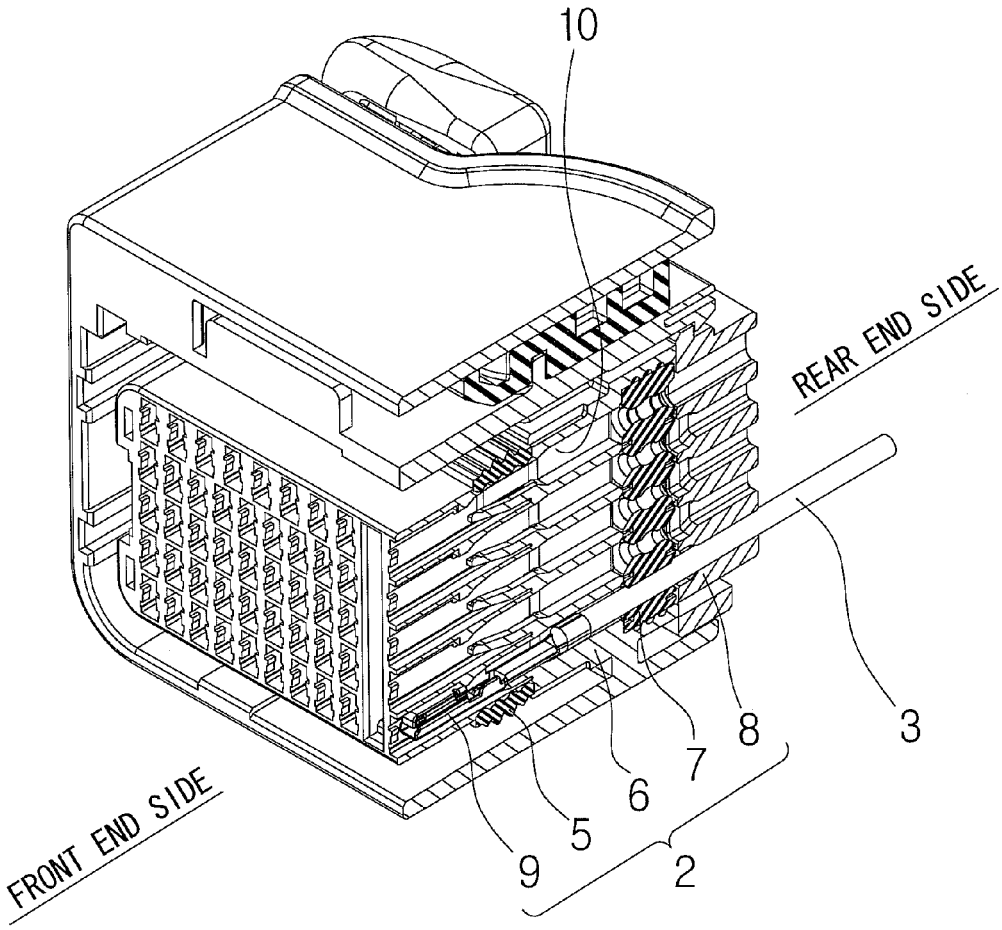
FIG. 2 is a cross-sectional perspective view of the electrical connector with front retainer omitted (first exemplary embodiment)
Figure 3:
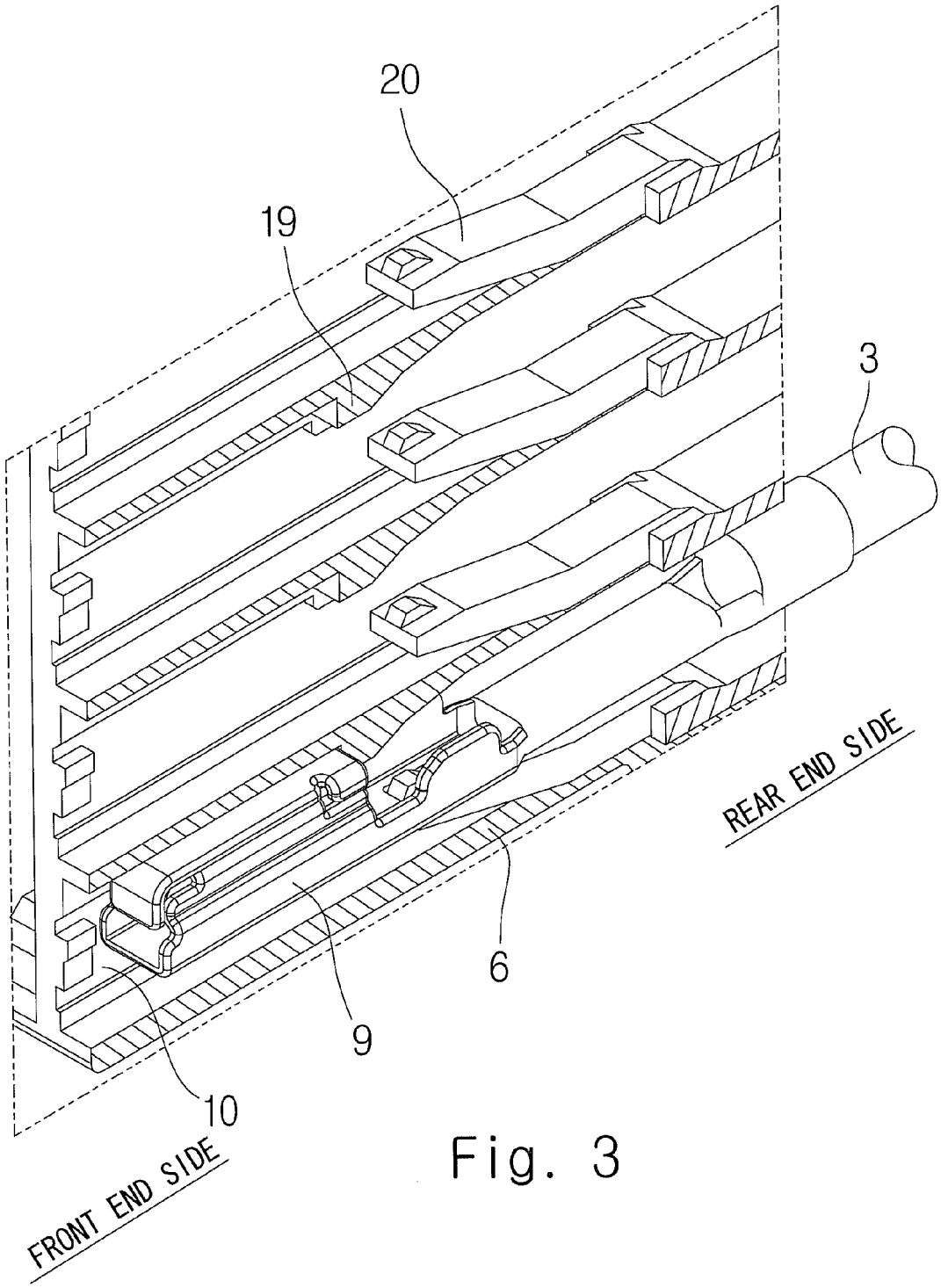
FIG. 3 is a partially enlarged view of FIG. 2 (first exemplary embodiment)
Figure 4:
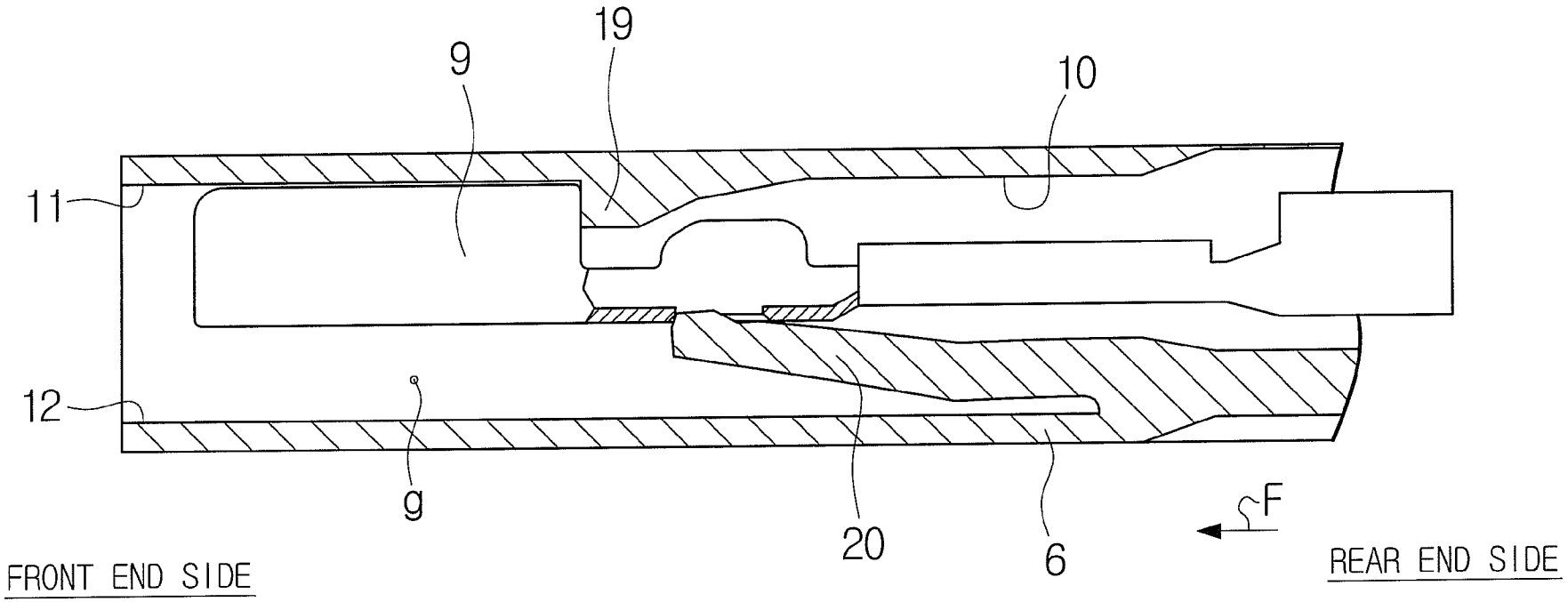
FIG. 4 is a cross-sectional view showing a primary locked state (first exemplary embodiment)
Figure 5:
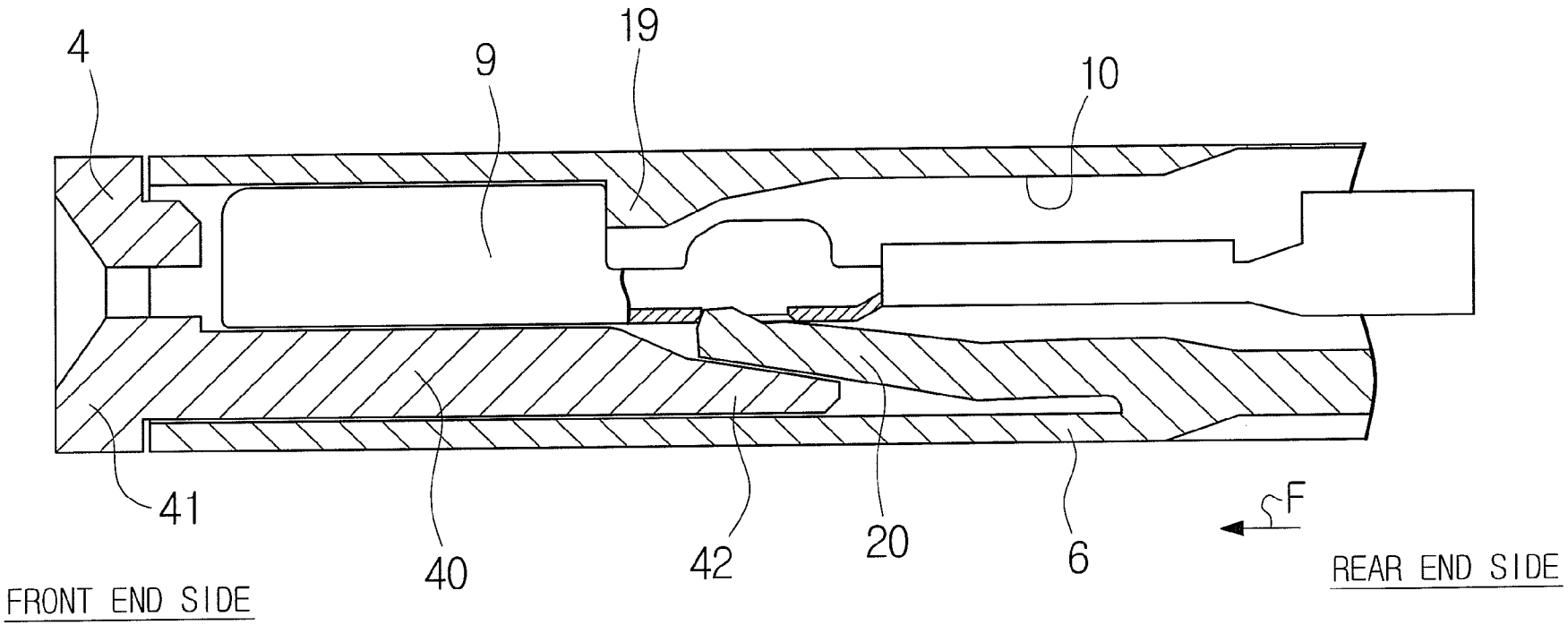
FIG. 5 is a cross-sectional view showing a secondary locked state (first exemplary embodiment)

FIGS. 2 to 5 each shows a state in which the female contact 9 inserted into the housing 6 is retained. FIGS. 2 to 4 each shows a primary locked state, which is a state in which the female contact 9 is locked in the housing 6 before the front retainer 4 is attached. FIG. 5 shows a secondary locked state, which is a state in which the female contact 9 is firmly locked in the housing 6 after the front retainer 4 is attached.

In FIG. 2, the left side which is a fitting side with the mating connector (not shown) is defined as a "front end side", and the right side which is a side in which the electric wires 3 are drawn out is defined as a "rear end side".

(Summary of Housing 6: FIGS. 2 to 5)

As shown in FIGS. 2 to 5, the housing 6 includes a cavity 10 into which the female contact 9 can be inserted. In FIG. 4, the female contact 9 is inserted into the cavity 10 of the housing 6 from the rear end side to the front end side. In other words, a contact insertion direction F of the female contact 9 is a direction from the rear end side toward the front end side. The front retainer 4 and the sealing member 5 are attached to the housing 6 from the front end side, and the grommet 7 and the rear cover 8 are attached to the housing 6 from the rear end side. The sealing member 5 prevents moisture or foreign substances from entering the cavity 10 from the front end side, and seals the part between the waterproof connector 2 and the mating connector (not shown) when both connectors are fitted each other. The grommet 7 similarly prevents moisture or foreign substances from entering the cavity 10 from the rear end side. The rear cover 8 retains the grommet 7 with the state in which the grommet 7 is attached to the housing 6.

As shown in FIG. 4, the housing 6 includes a first inner wall surface 11, a second inner wall surface 12, a first engaging part 19, and a lance 20 (pressing piece). The first inner wall surface 11 defines the cavity 10, and is substantially parallel to the contact insertion direction F. The second inner wall surface 12 is parallel to the first inner wall surface 11, and is opposed to the first inner wall surface 11. The first engaging part 19 is formed to protrude from the first inner wall surface 11 toward the second inner wall surface 12. The lance 20 is formed in the second inner wall surface 12, and presses the female contact 9 inserted into the cavity 10 toward the first inner wall surface 11.

(Female Contact 9: FIGS. 6 to 9)

Figure 6:
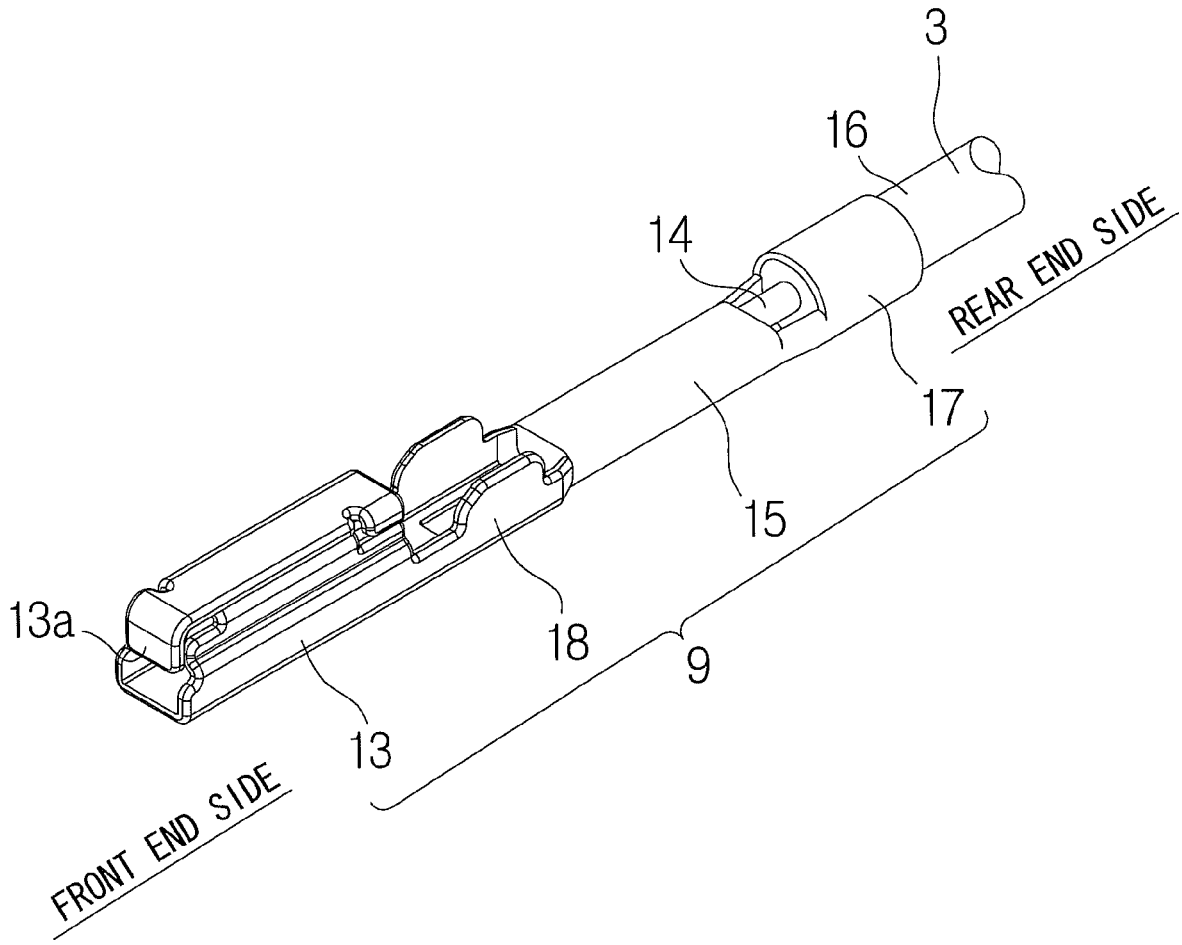
FIG. 6 is a perspective view of a contact (first exemplary embodiment)
Figure 7:
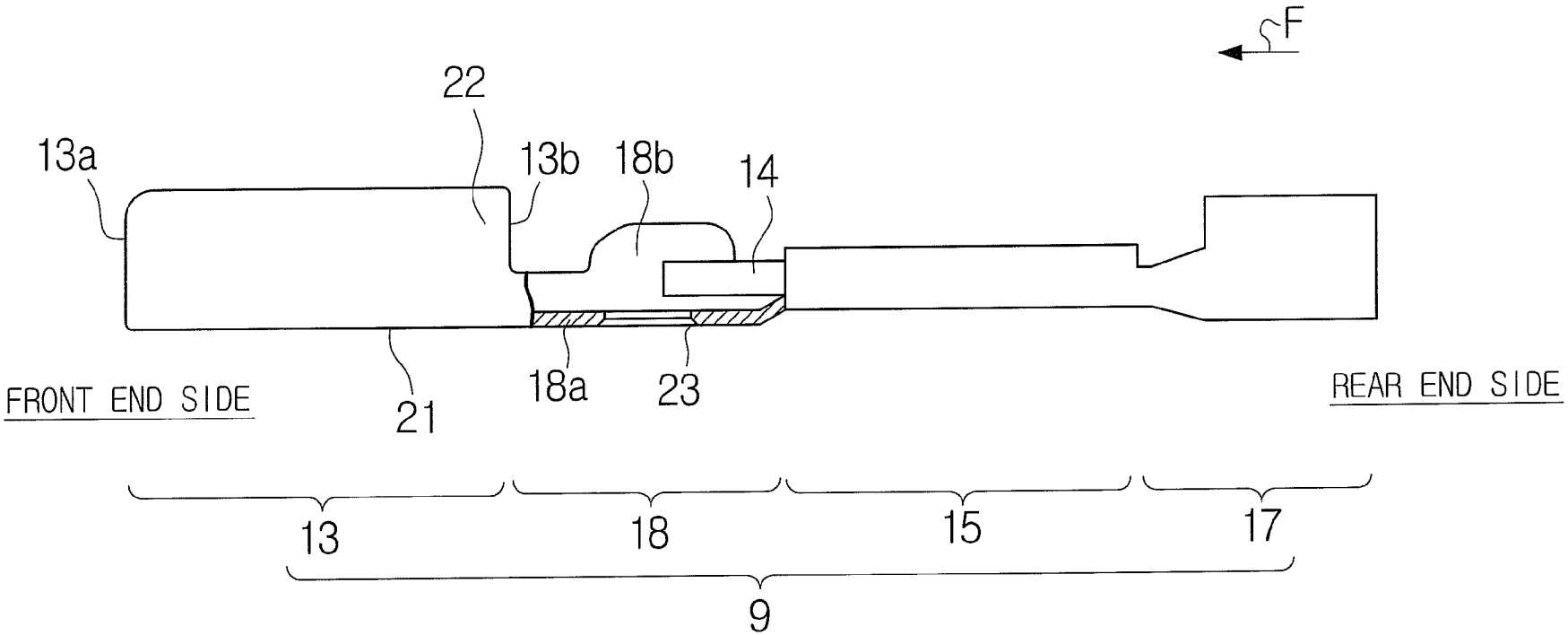
FIG. 7 is a partial cutout side view of the contact (first exemplary embodiment)

Next, with reference to FIGS. 6 to 9, the female contact 9 will be described. As shown in FIGS. 6 and 7, in the first exemplary embodiment, the female contact 9 is integrally formed by sheet metal working, and includes a contact body 13 into which a contact part of the male contact (not shown) is inserted, a core wire barrel 15 that is provided to fix a core wire 14 (central conductor) of the electric wire 3 to the female contact 9 by crimping, a coating barrel 17 that is provided to fix insulating coating 16 of the electric wire 3 to the female contact 9 by crimping, and a coupling part 18 that couples the contact body 13 and the core wire barrel 15. Further, as shown in FIG. 7, a pressed surface 21 pressed by the lance 20 (see also FIG. 4) is formed in the contact body 13 and the coupling part 18.

The contact body 13 is formed to protrude in a direction away from the pressed surface 21 as shown in FIG. 7, and has a substantially box shape as shown in FIG. 6. The contact body 13 includes a front end side wall surface 13*a* and a rear end side wall surface 13*b* (first engaged surface) as shown in FIGS. 6 and 7. A first engaged part 22 is formed near the rear end side wall surface 13*b*. In other words, the contact body 13 includes the first engaged part 22, the first engaged part 22 is formed to protrude in a direction away from the pressed surface 21, and the first engaged part 22 includes the rear end side wall surface 13*b*.

Figure 8:
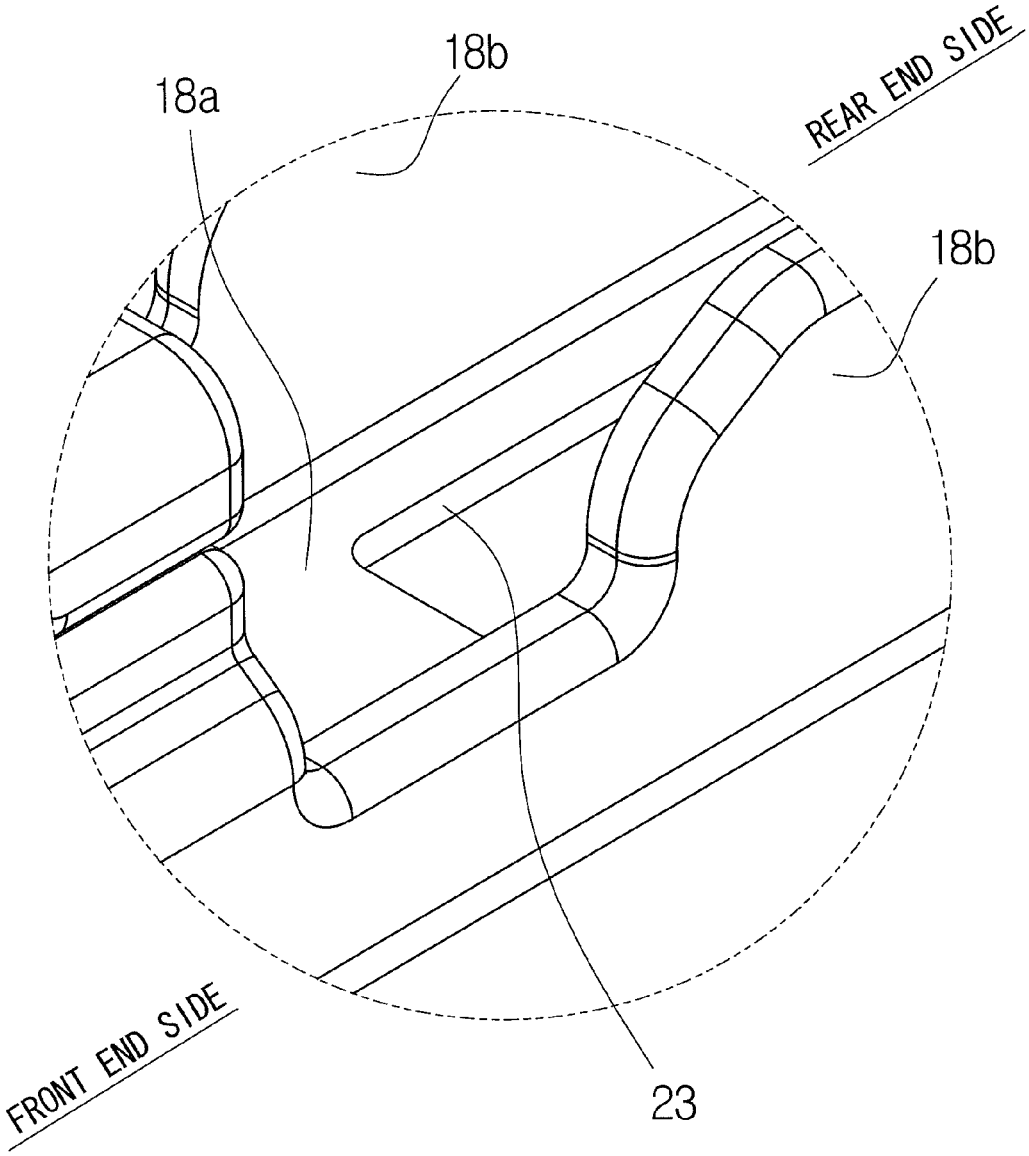
FIG. 8 is a partially enlarged view of FIG. 6 (first exemplary embodiment)
Figure 9:
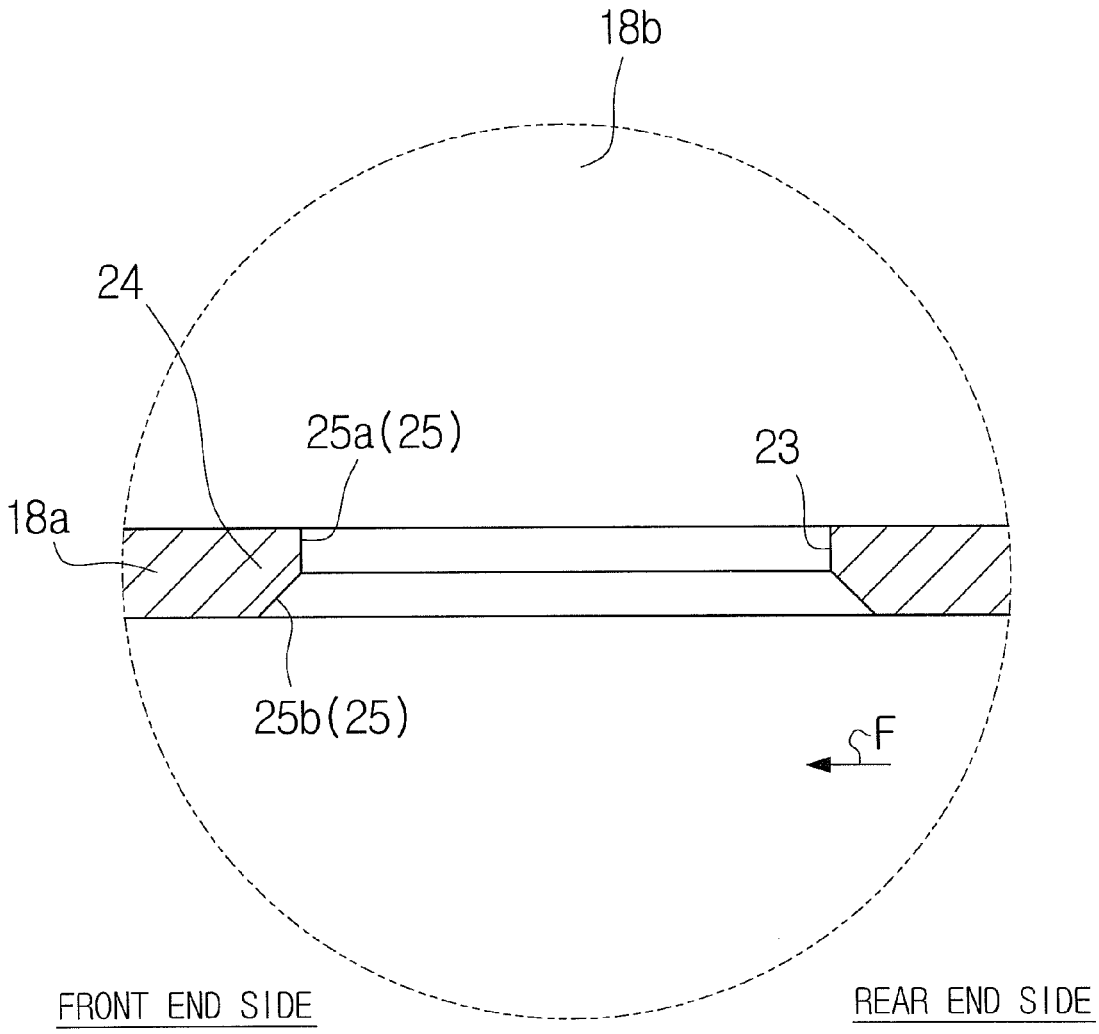
FIG. 9 is a cross-sectional view of a lance lock hole (first exemplary embodiment)

The coupling part 18 includes a base plate 18*a* that forms a part of the pressed surface 21, a pair of protection side plates 18*b*, and has a substantially U shape in cross section. The protection side plates 18*b* surround the core wire 14 protruded from the core wire barrel 15, thereby preventing the core wire 14 from being caught by the grommet 7 when the female contact 9 is inserted into the cavity 10 of the housing 6 as shown in FIG. 2. Further, as shown in FIG. 8, a lance lock hole 23 (hole) having a substantially rectangular shape in plane view is formed in the base plate 18*a*. As shown in FIG. 9, the base plate 18*a* includes a second engaged part 24 that is adjacent to the lance lock hole 23 in the front end side. This second engaged part 24 includes a second engaged surface 25. The second engaged surface 25 is formed as a part of an inner peripheral surface of the lance lock hole 23. The second engaged surface 25 includes a straight surface 25*a* that is located on the side of the first inner wall surface 11, and a tapered surface 25*b* (inclined surface) that is located on a side of the second inner wall surface 12. The straight surface 25*a* is formed to be perpendicular to the contact insertion direction F. The tapered surface 25*b* connects to the straight surface 25*a*, and is formed to be inclined in the side of the contact insertion direction F.

Figure 10:
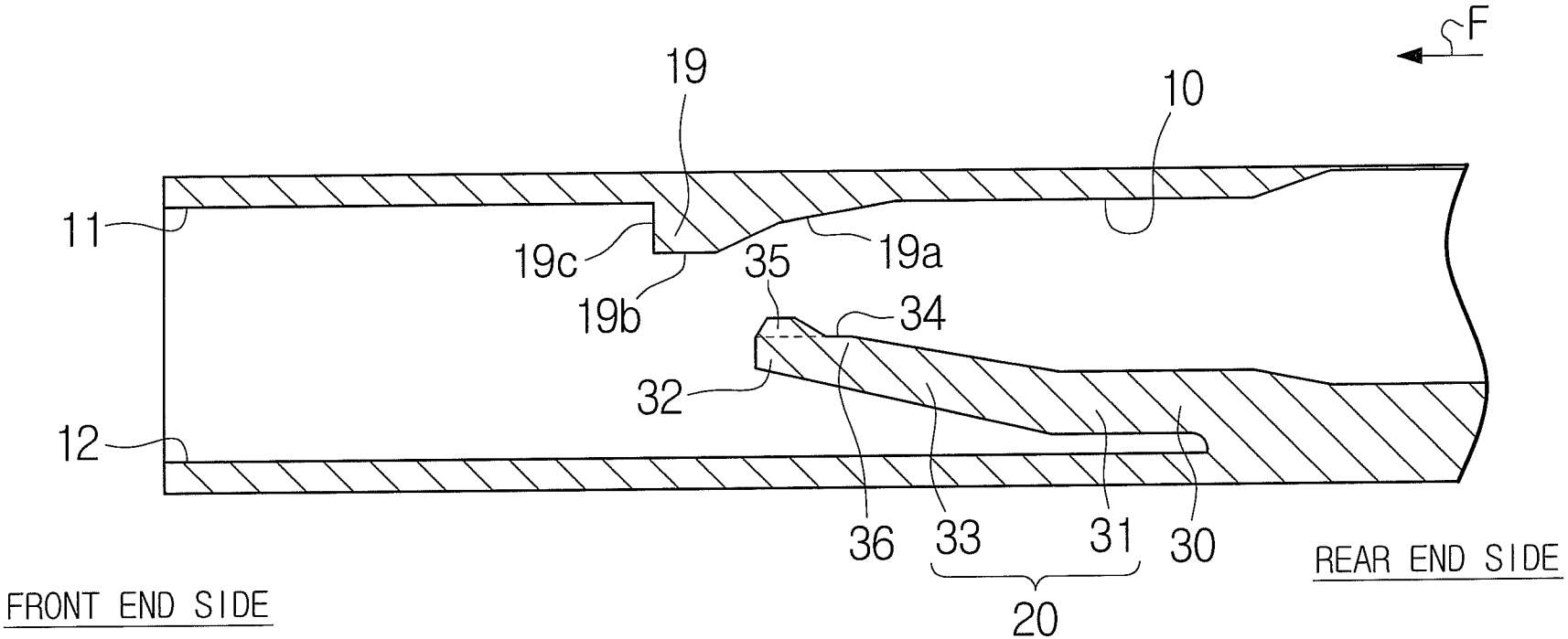
FIG. 10 is a partially cross-sectional side view of a housing (first exemplary embodiment)
Figure 11:
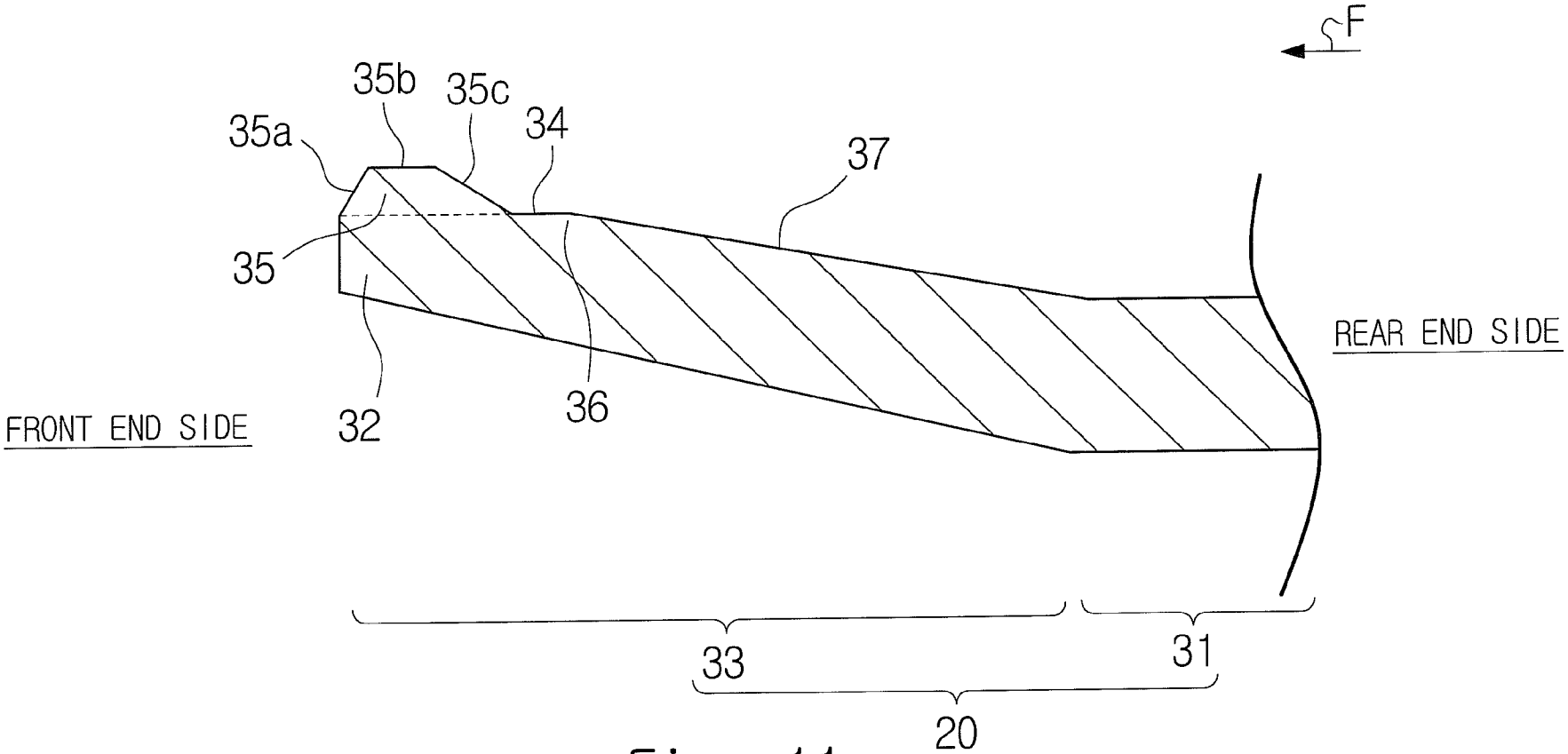
FIG. 11 is a cross-sectional side view of a lance (first exemplary embodiment)
Figure 12:
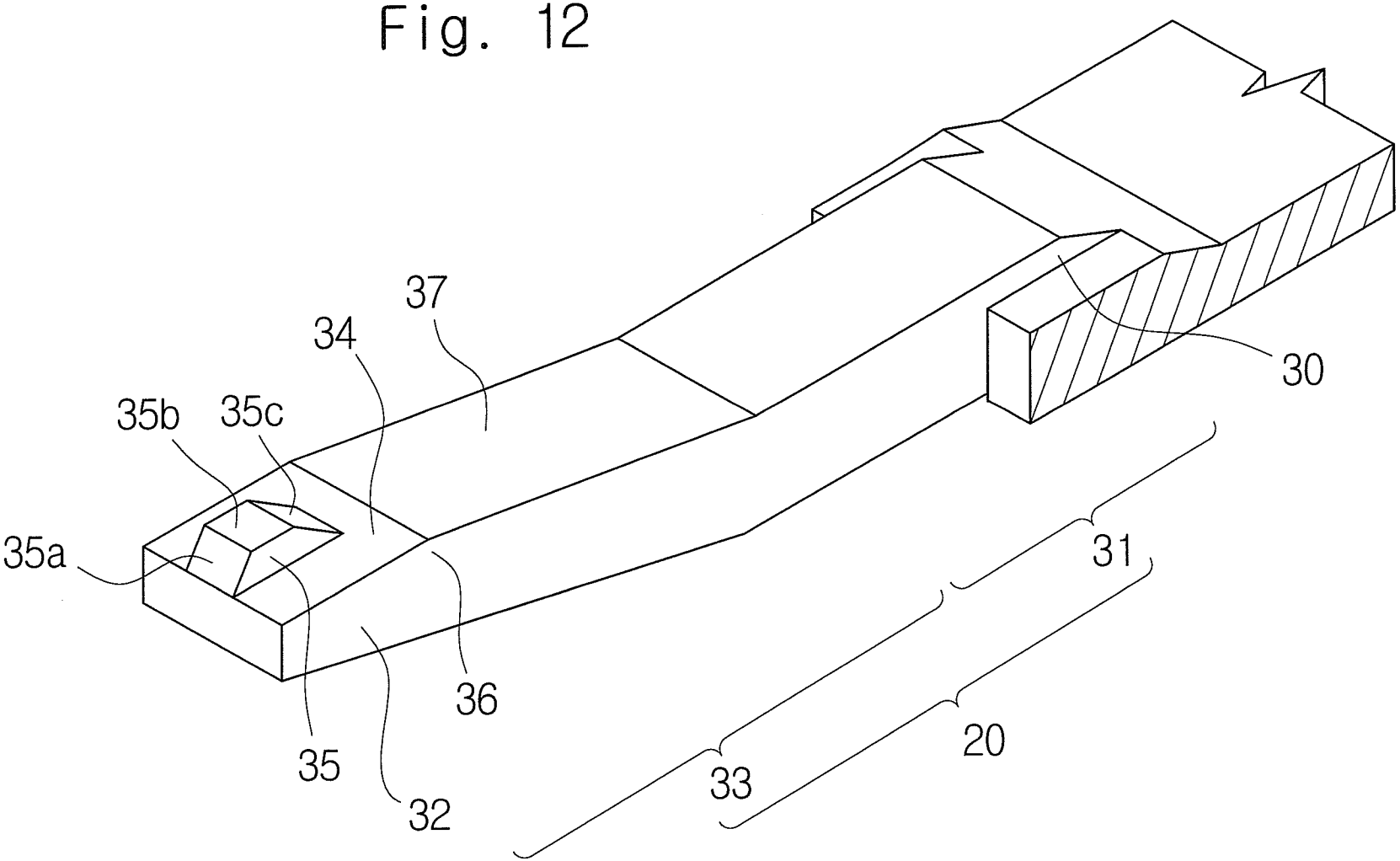
FIG. 12 is a perspective view of the lance (first exemplary embodiment)

(Detail of Housing 6: FIGS. 10 to 12)

As shown in FIG. 10, the first engaging part 19 includes a running-on guide surface 19*a*, a parallel guide surface 19*b*, and a first engagement surface 19*c*. The running-on guide surface 19*a* is a surface in the rear end side of the first engaging part 19, and is formed to have an inclined shape so as to approach the second inner wall surface 12 from the rear end side toward the front end side. The parallel guide surface 19*b* is formed to be substantially parallel to the first inner wall surface 11. The first engagement surface 19*c* is a surface in the front end side of the first engaging part 19, and is formed to be substantially perpendicular to the contact insertion direction F.

As shown in FIG. 10, the lance 20 is supported by the second inner wall surface 12, and is formed in a cantilevered shape so as to extend from the rear end side to the front end side in the cavity 10. The lance 20 includes a lance parallel part 31 including a fixed end 30 of the lance 20 and a lance inclined part 33 including a free end 32 of the lance 20 in an unloaded condition of the lance 20 shown in FIG. 10. The lance parallel part 31 extends substantially parallel to the contact insertion direction F in the unloaded condition. The lance inclined part 33 is formed to have an inclined shape so as to be away from the second inner wall surface 12 toward the front end side in the unloaded condition and approach the first inner wall surface 11.

As shown in FIGS. 10 to 12, a horizontal surface 34 and a second engaging part 35 are formed in the free end 32 of the lance 20. The horizontal surface 34 is substantially parallel to the second inner wall surface 12 in the unloaded condition. The second engaging part 35 is formed in the horizontal surface 34. As shown in FIG. 10, the second engaging part 35 is formed to protrude from the horizontal surface 34 toward the first inner wall surface 11. As shown in FIG. 10, the second engaging part 35 is formed in a substantially trapezoidal shape in cross-sectional side view so that the second engaging part 35 gradually becomes narrower toward the first inner wall surface 11. As shown in FIG. 11, the second engaging part 35 includes a second engaging part front end inclined surface 35*a* (second engagement surface) which is a surface of the second engaging part 35 in the front end side, a second engaging part horizontal surface 35*b* which is horizontal to the horizontal surface 34, and a second engaging part rear end inclined surface 35*c* which is a surface of the second engaging part 35 in the rear end side. Further, as shown in FIG. 12, a V-shaped bent part 36 is formed between the free end 32 and the fixed end 30 of the lance 20. Specifically, as shown in FIGS. 11 and 12, the V-shaped bent part 36 is formed between the horizontal surface 34 and an inclined surface 37 that is adjacent to the horizontal surface 34 in the rear end side.

As shown in FIG. 10, the lance 20 is formed on the rear end side with respect to the first engaging part 19. Specifically, the second engaging part 35 of the lance 20 is formed in the rear end side with respect to the first engaging part 19. Note that the second engaging part front end inclined surface 35*a* (second engagement surface) of the second engaging part 35 and the second engaged surface 25 (straight surface 25*a* or tapered surface 25*b*) may either be abutted or not in each of the primary locked state and the secondary locked state.

(Front Retainer 4: FIG. 5)

As shown in FIG. 5, the front retainer 4 includes a retainer 40 inserted into a retainer gap g formed between the female contact 9 and the second inner wall surface 12 in the primary locked state shown in FIG. 4, and a retainer coupling body 41 that couples a plurality of retainers 40. As shown in FIG. 5, the retainer 40 is inserted into the retainer gap g (see FIG. 4), thereby substantially preventing the movement of the female contact 9 inserted into the cavity 10 in a direction perpendicular to the contact insertion direction F. In summary, it is possible to prevent the lance 20 from being elastically deformed in the side of the second inner wall surface 12. As shown in FIG. 5, an erroneous insertion detector 42 having a tip tapered shape is provided at the tip of the retainer 40. The erroneous insertion detector 42 can be inserted between the second inner wall surface 12 and the lance 20 in the primary locked state as shown in FIG. 4. Meanwhile, when the lance 20 is displaced in the side of the second inner wall surface 12, the tips of the erroneous insertion detector 42 and the lance 20 hit each other. Therefore, that the retainer 40 is able to be smoothly inserted into the retainer gap g means that the engagement state of the female contact 9 is in the primary locked state as shown in FIG. 4.

(Assembling of Harness 1: FIGS. 13 to 16)

Figure 13:
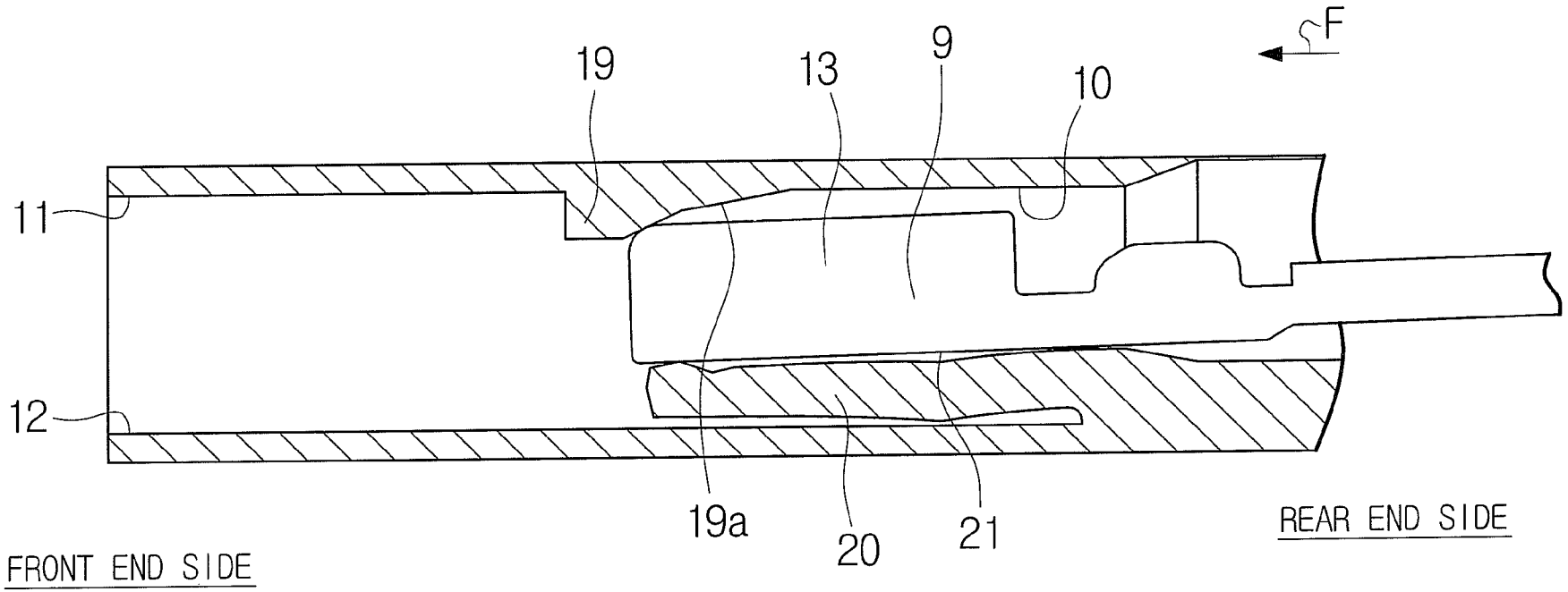
FIG. 13 is a first cross-sectional view showing a state in which the contact is inserted into the housing (first exemplary embodiment)

Next, assembling of the harness 1 will be described. In order to assemble the harness 1, as shown in FIG. 2, the grommet 7 and the rear cover 8 are attached to the housing 6 in advance, and the front retainer 4 is kept removed. Then, as shown in FIG. 13, the female contact 9 is inserted into the cavity 10 from the rear end side. Then the contact body 13 of the female contact 9 is guided in the side of the second inner wall surface 12 along the running-on guide surface 19*a* of the first engaging part 19. In accordance therewith, the pressed surface 21 of the female contact 9 presses the lance 20 in the side of the second inner wall surface 12.

Figure 14:
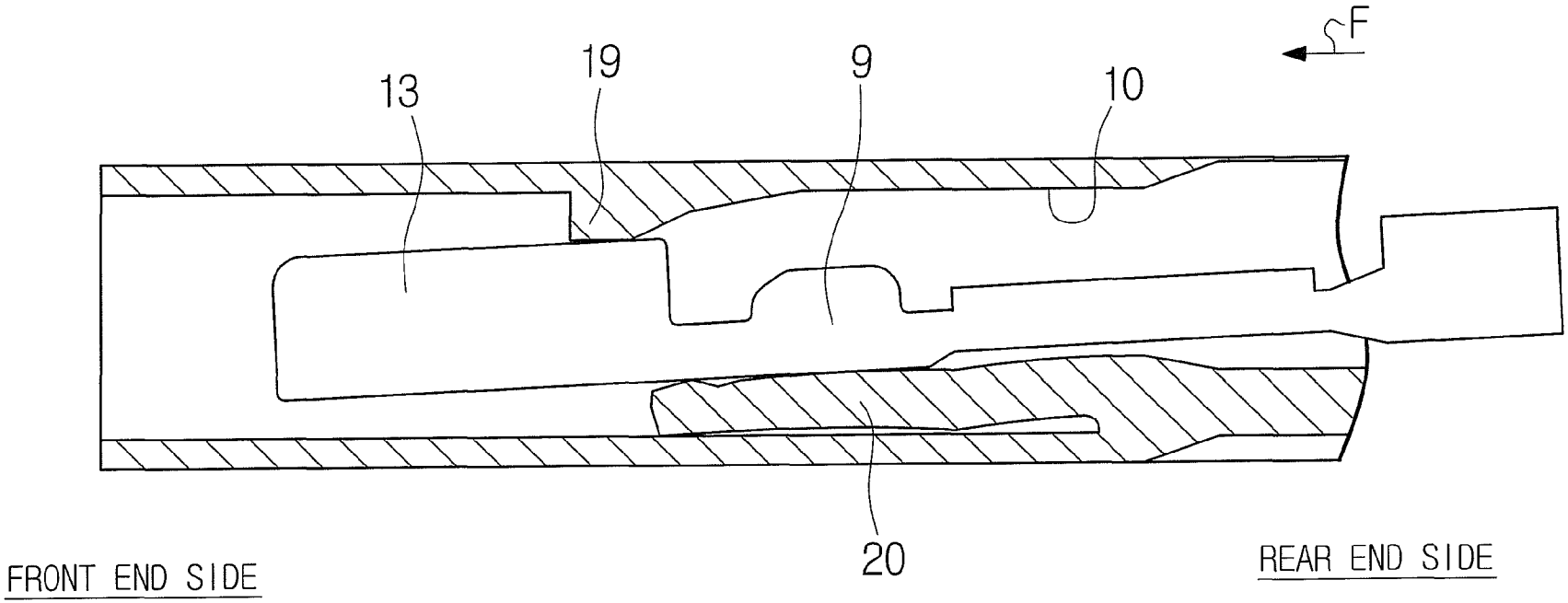
FIG. 14 is a second cross-sectional view showing a state in which the contact is inserted into the housing (first exemplary embodiment)

When the female contact 9 is continuously inserted into the cavity 10 as shown in FIG. 14, the contact body 13 of the female contact 9 is held between the first engaging part 19 and the lance 20 in the direction perpendicular to the contact insertion direction F.

Figure 15:
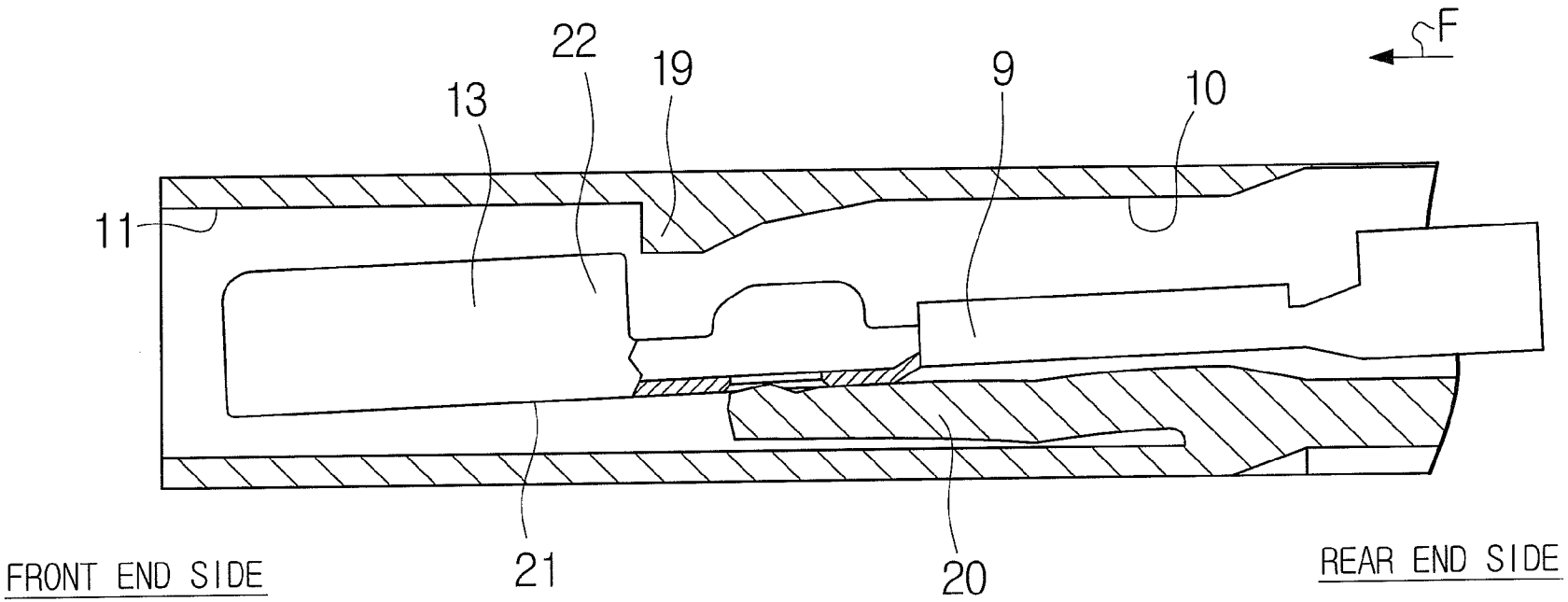
FIG. 15 is a third cross-sectional view showing a state in which the contact is inserted into the housing (first exemplary embodiment)
Figure 16:
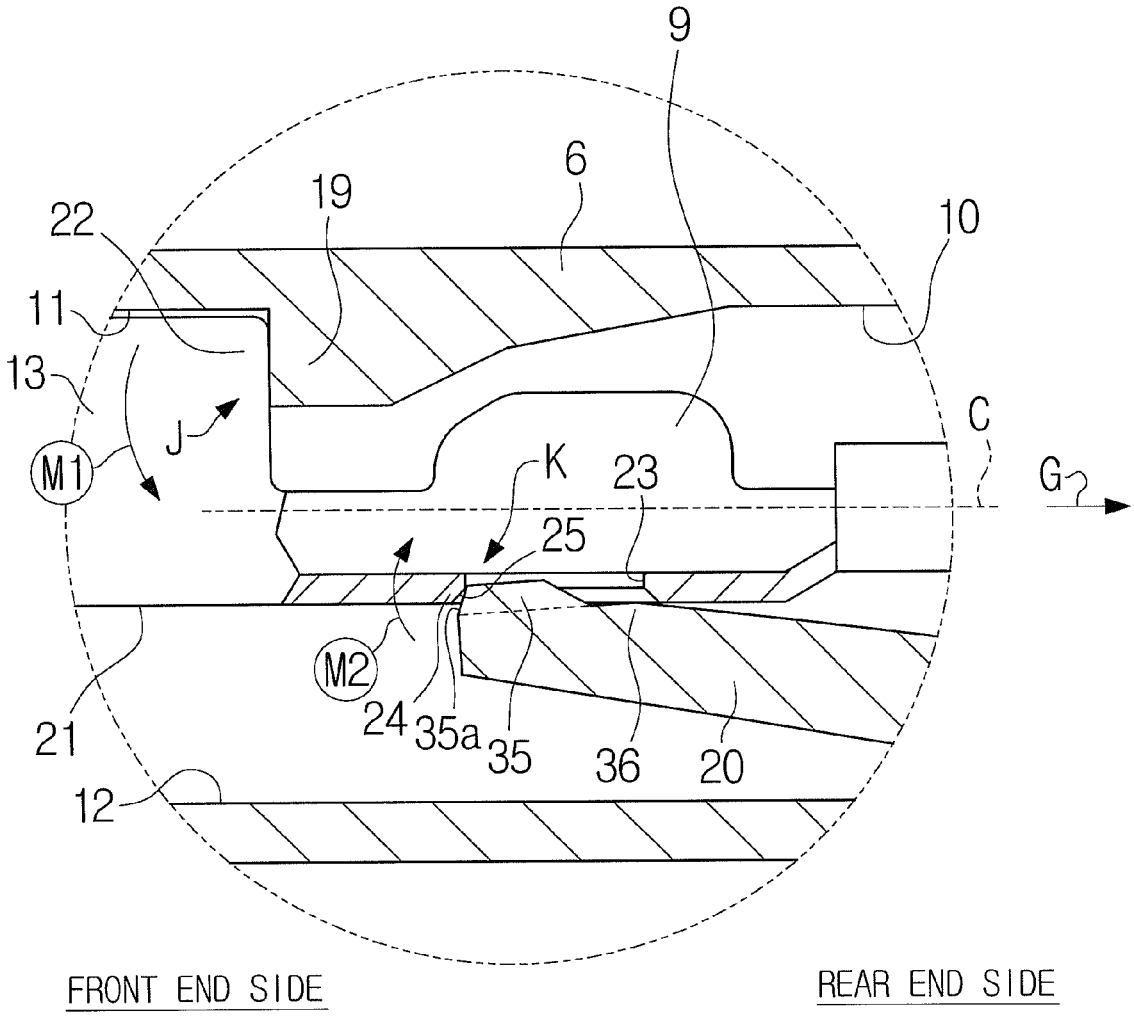
FIG. 16 is a partially enlarged view of FIG. 4 (first exemplary embodiment)

When the female contact 9 is continuously inserted into the cavity 10 as shown in FIG. 15, the first engaged part 22 of the contact body 13 of the female contact 9 moves beyond the first engaging part 19, and the lance 20 presses the pressed surface 21 of the female contact 9 toward the first inner wall surface 11 by self elastic restoration force. Due to the pressing force of the lance 20, the female contact 9 moves toward the first inner wall surface 11. As a result, as shown in FIG. 16, the first engaged part 22 of the female contact 9 is engaged with the first engaging part 19. Hereinafter, the engagement of the first engaging part 19 and the first engaged part 22 of the female contact 9 is referred to as a first engagement J (first engagement). FIG. 16 shows the primary locked state (see also FIG. 4). In the primary locked state shown in FIG. 16, the V-shaped bent part 36 of the lance 20 contacts the pressed surface 21 of the female contact 9. Further, the second engaging part 35 of the lance 20 enters the lance lock hole 23 of the female contact 9, and the second engaging part front end inclined surface 35*a* abuts the second engaged surface 25. Accordingly, the second engaged part 24 of the female contact 9 can be engaged with the second engaging part 35 of the lance 20. Hereinafter, the engagement of the second engaged part 24 of the female contact 9 and the second engaging part 35 of the lance 20 is referred to as a second engagement K (second engagement). Now, the first engagement J and the second engagement K are achieved to hold a central axis C of the female contact 9 or the core wire 14 of the electric wire 3 (see also FIG. 6). In summary, in a cross-sectional side view shown in FIG. 16, the first engagement J is achieved on the side of the first inner wall surface 11 seen from the central axis C, and the second engagement K is achieved on the side of the second inner wall surface 12 seen from the central axis C. Accordingly, when pull-out force G which is the force to pull out the female contact 9 from the housing 6 acts on the female contact 9 in the primary locked state shown in FIG. 16, a first moment M1 in the counterclockwise direction due to the first engagement J and a second moment M2 in the clockwise direction due to the second engagement K are generated in the female contact 9. Now, since the first moment M1 and the second moment M2 are cancelled each other, the female contact 9 is hardly inclined in the cavity 10 and the first engagement J is hardly released, thereby making the female contact 9 hardly released unintentionally from the housing 6.

The front retainer 4 is attached to the housing 6 in the primary locked state shown in FIG. 16. In short, the retainer 40 is inserted into the retainer gap g shown in FIG. 4. Accordingly, the secondary locked state as shown in FIG. 5 is achieved. In the secondary locked state, the movement of the female contact 9 in the direction perpendicular to the contact insertion direction F is prevented.

(Disassembling of Harness 1: FIGS. 16 to 20)

Figure 17:
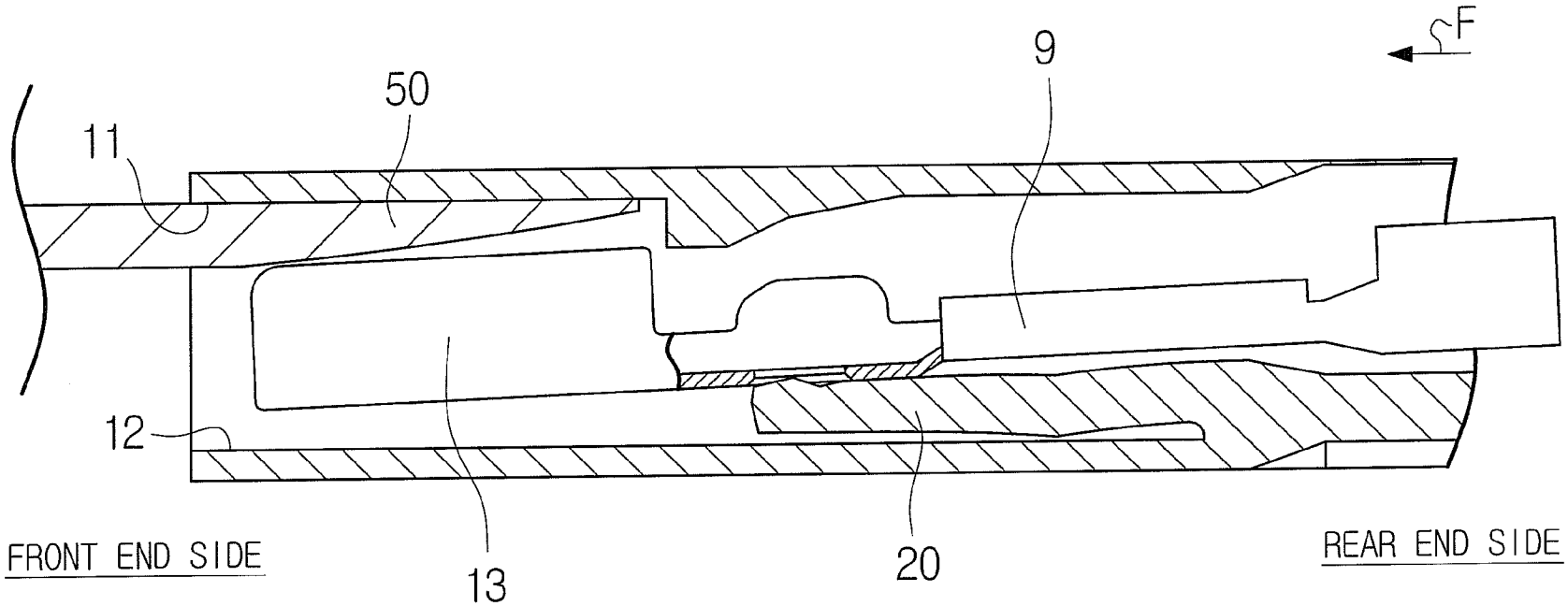
FIG. 17 is a cross-sectional view showing a state in which first engagement is forcibly released (first exemplary embodiment)
Figure 18:
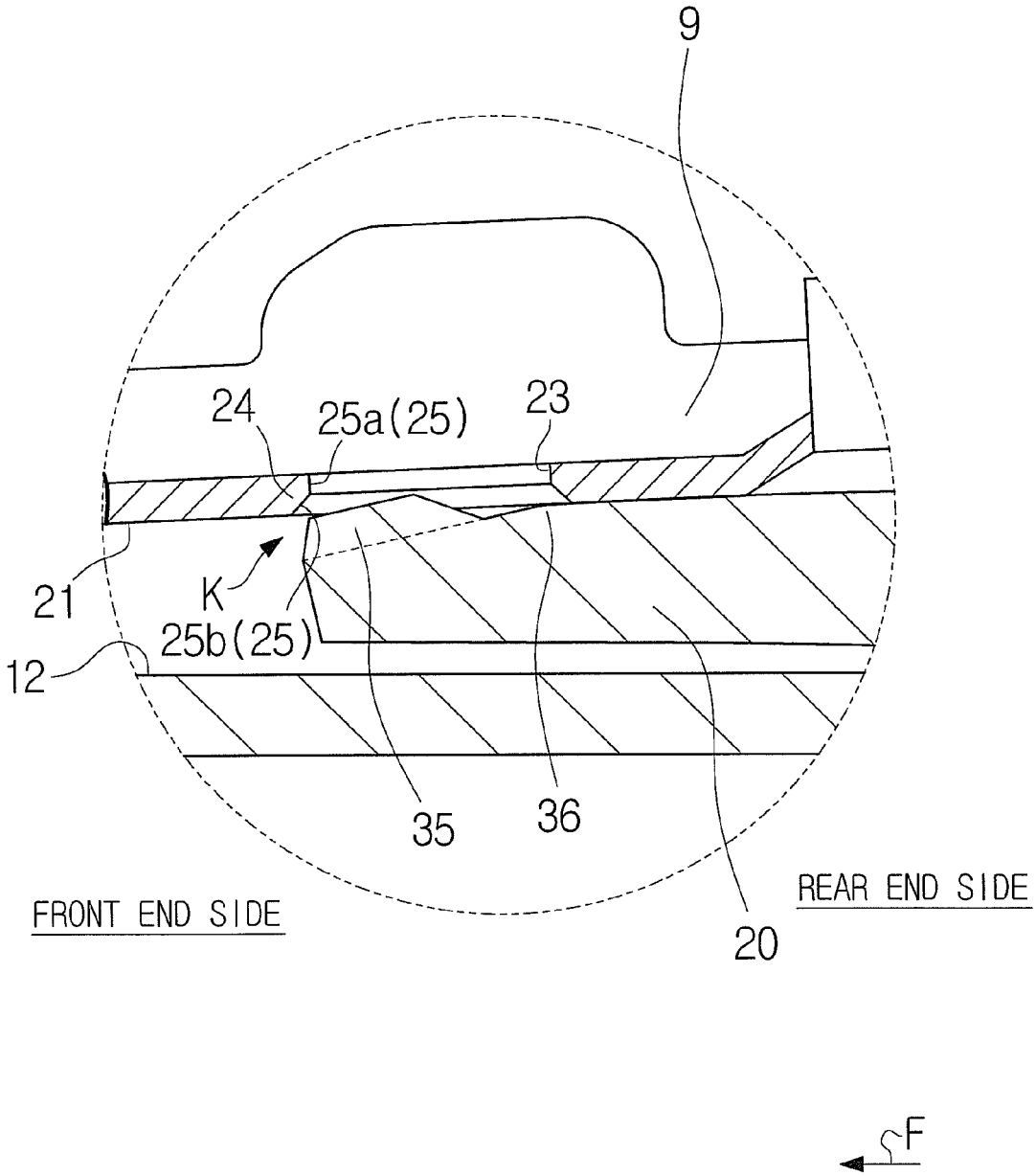
FIG. 18 is a partially enlarged view of FIG. 17 (first exemplary embodiment)

In order to disassemble the harness 1 which is in the secondary locked state shown in FIG. 5, the front retainer 4 is detached from the housing 6, which makes the state back to the primary locked state shown in FIG. 4. Next, as shown in FIG. 17, an engagement releasing tool 50 having a sharp tip is inserted between the first inner wall surface 11 and the contact body 13 of the female contact 9, thereby moving the female contact 9 in the side of the second inner wall surface 12. Accordingly, the first engagement J shown in FIG. 16 is forcibly released. Further, as shown in FIG. 18, when the female contact 9 moves in the side of the second inner wall surface 12, the pressed surface 21 of the female contact 9 continues to contact with the V-shaped bent part 36 of the lance 20. Accordingly, when the lance 20 is moved in the side of the second inner wall surface 12, the second engaging part 35 of the lance 20 seems to be displaced to rotate in the counterclockwise direction about the V-shaped bent part 36 when seen from the female contact 9. As a result, the second engaging part 35 is partially removed in the side of the second inner wall surface 12 from the lance lock hole 23, which weakens the second engagement K. After the state shown in FIG. 18 is achieved, the female contact 9 is just pulled out from the housing 6 in the direction opposite to the contact insertion direction F by pulling the electric wires 3, for example. When the female contact 9 is pulled out in the direction opposite to the contact insertion direction F from the state shown in FIG. 18, the second engagement K which has already been weakened is easily and completely released, whereby the female contact 9 can be smoothly removed from the housing 6. Since the tapered surface 25*b* is formed in the second engaged surface 25 of the second engaged part 24, the second engaged surface 25 of the second engaged part 24 hardly damages the second engaging part 35 of the lance 20 when the female contact 9 is pulled out despite the condition in which there still remains some second engagement K.

Described above is the first exemplary embodiment that is preferred according to the present invention. In summary, the first exemplary embodiment has the following features.

A waterproof connector 2 (electrical connector) includes a female contact 9 (contact) and a housing 6 that includes a cavity 10 into which the female contact 9 can be inserted. The housing 6 includes a first inner wall surface 11 that defines the cavity 10 and is substantially parallel to a contact insertion direction F, a second inner wall surface 12 which is opposed to the first inner wall surface 11, a first engaging part 19 that is formed to protrude from the first inner wall surface 11 toward the second inner wall surface 12, and a lance 20 (pressing piece) that is formed in the second inner wall surface 12 and presses the female contact 9 that is inserted into the cavity 10 toward the first inner wall surface 11. The female contact 9 includes a pressed surface 21 pressed by the lance 20, and a first engaged part 22 that is formed to protrude in a direction away from the pressed surface 21. When the female contact 9 is inserted into the cavity 10 and the first engaged part 22 moves beyond the first engaging part 19, the female contact 9 moves toward the first inner wall surface 11 due to the pressing force by the lance 20, and a primary locked state is achieved in which the first engaged part 22 is engaged with the first engaging part 19. In order to achieve a first engagement J (first engagement) by the first engaging part 19 and the first engaged part 22 and a second engagement K (second engagement) by the housing 6 and the female contact 9 on a side opposite to the side where the first engagement is performed with respect to a central axis C of the female contact 9, a second engaging part 35 is formed in the housing 6, and a second engaged part 24 that is capable of being engaged with the second engaging part 35 is formed in the female contact 9. With the structure above, when the pull-out force G which is the force to pull out the female contact 9 from the housing 6 acts on the female contact 9 in the primary locked state, a first moment M1 (first moment) is generated in the female contact 9 due to the first engagement J. The first moment M1 inclines the female contact 9 in the cavity 10 to release the first engagement J. According to the structure of the present invention, a second moment M2 (second moment) which is opposite to the first moment M1 is also generated due to the second engagement K (second engagement). Accordingly, in the primary locked state, when the pull-out force G acts on the electric wire 3 or the female contact 9, the female contact 9 is hardly inclined in the cavity 10 and the first engagement J is hardly released, thereby making the female contact 9 hardly released from the housing 6.

Further, the second engaging part 35 is formed in the lance 20.

Further, the second engaged part 24 is formed by forming a lance lock hole 23 on the pressed surface 21. According to the structure stated above, the base plate 18*a* does not interfere with the core wire 14.

Further, the lance 20 is formed in a cantilevered shape while being supported by the second inner wall surface 12. The second engaging part 35 is formed in the free end 32 of the lance 20. A V-shaped bent part 36 (abutted part) that contacts with the pressed surface 21 of the female contact 9 in the primary locked state is formed between the free end 32 and a fixed end 30 of the lance 20. According to the structure stated above, when the first engagement J is released by inserting the engagement releasing tool 50 between the female contact 9 and the first inner wall surface 11 and moving the female contact 9 in the side of the second inner wall surface 12, the second engagement K weakens substantially at the same when the first engagement J is released. Accordingly, it is possible to intentionally pull out the female contact 9 from the housing 6 without preparing any special engagement releasing tools to forcibly cancel the second engagement K.

Further, a tapered surface 25*b* (inclined surface) that inclines to be away from the second engaging part 35 toward the second inner wall surface 12 is formed in a second engaged surface 25 of the second engaged part 24 with respect to the second engaging part 35. If the second engagement K is not completely released when the female contact 9 is intentionally pulled out from the housing 6, the second engaged part 24 may partially damage the second engaging part 35. Meanwhile, according to the configuration above, due to the existence of the tapered surface 25*b*, the second engaged part 24 hardly damage the second engaging part 35 even when the second engagement K is not completely released when the female contact 9 is intentionally pulled out from the housing 6.

Further, as shown in FIG. 16, the second engagement K is performed in the near side of the contact insertion direction F compared with the first engagement J.

Further, as shown in FIG. 7, the lance lock hole 23 is formed to avoid the contact body 13. According to the structure stated above, the lance lock hole 23 does not give any effect on the conductive operation of the contact body 13, or the connection with the mating contact (not shown).

Furthermore, as shown in FIG. 7, the lance lock hole 23 is formed in the same position where the protection side plate 18*b* of the coupling part 18 is formed in side view. According to the structure stated above, a complementary relationship is established that complements the lack of strength of the female contact 9 due to the formation of the lance lock hole 23 by the protection side plate 18*b*, whereby the strength of the female contact 9 can be easily secured.

Second Exemplary Embodiment

Figure 19:
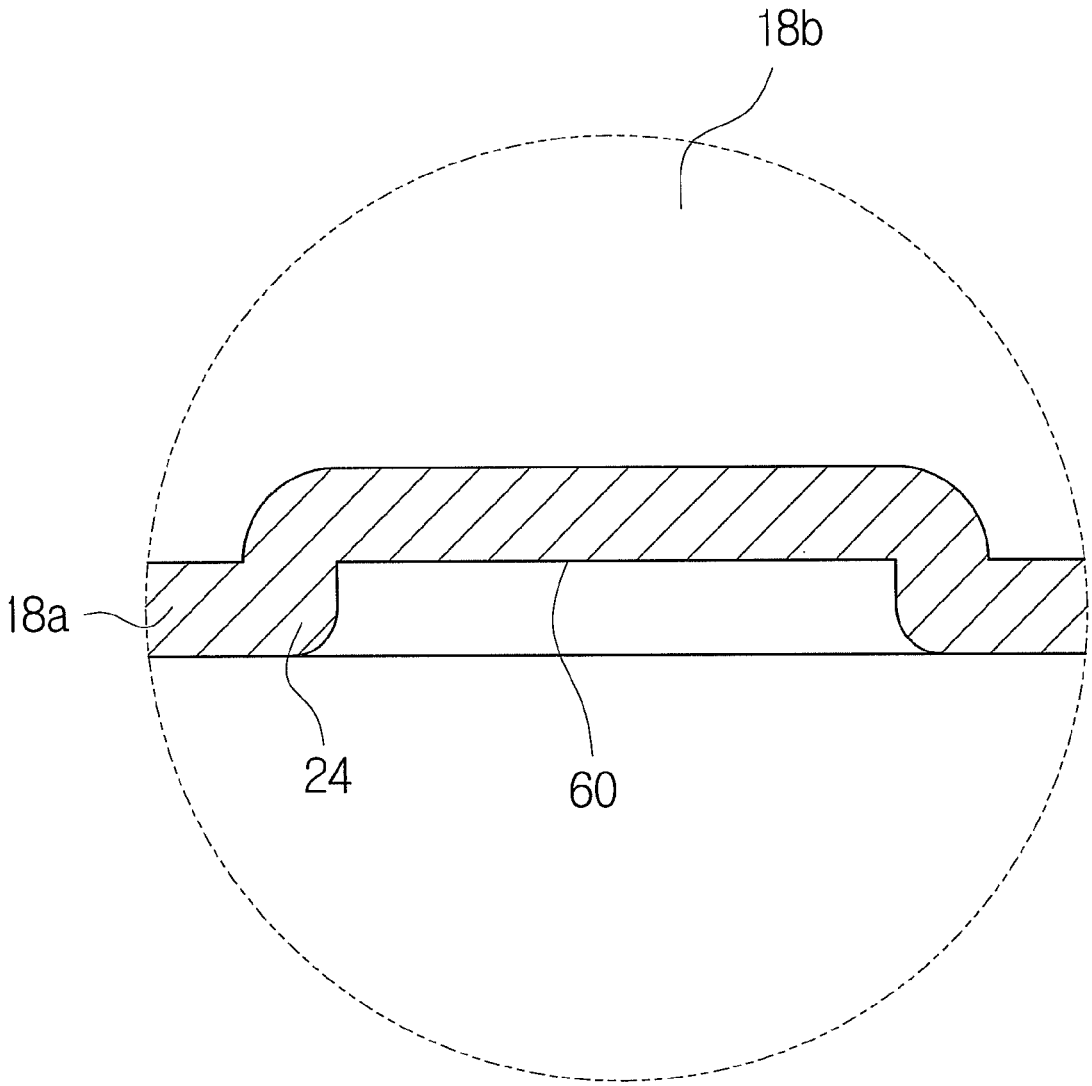
FIG. 19 is a cross-sectional view of a lance lock hole (second exemplary embodiment)

Next, a second exemplary embodiment of the present invention will be described with reference to FIG. 19. In this description, only the difference from the first exemplary embodiment will be mainly described, and the overlapping description will be omitted as appropriate. Further, in principle, the components corresponding to those in the first exemplary embodiment are denoted by the same reference symbols.

In the first exemplary embodiment described above, the second engaged part 24 is obtained by forming the lance lock hole 23 in the base plate 18*a* of the coupling part 18 of the female contact 9 as shown in FIG. 9. On the other hand, in the second exemplary embodiment, the second engaged part 24 is obtained by forming a concave 60 (recess) in the base plate 18*a* of the coupling part 18 of the female contact 9 as shown in FIG. 19. By forming the second engaged part 24 by the concave 60, a decrease in the strength of the female contact 9 can be efficiently suppressed compared with the first exemplary embodiment.

Third Exemplary Embodiment

Figure 20:
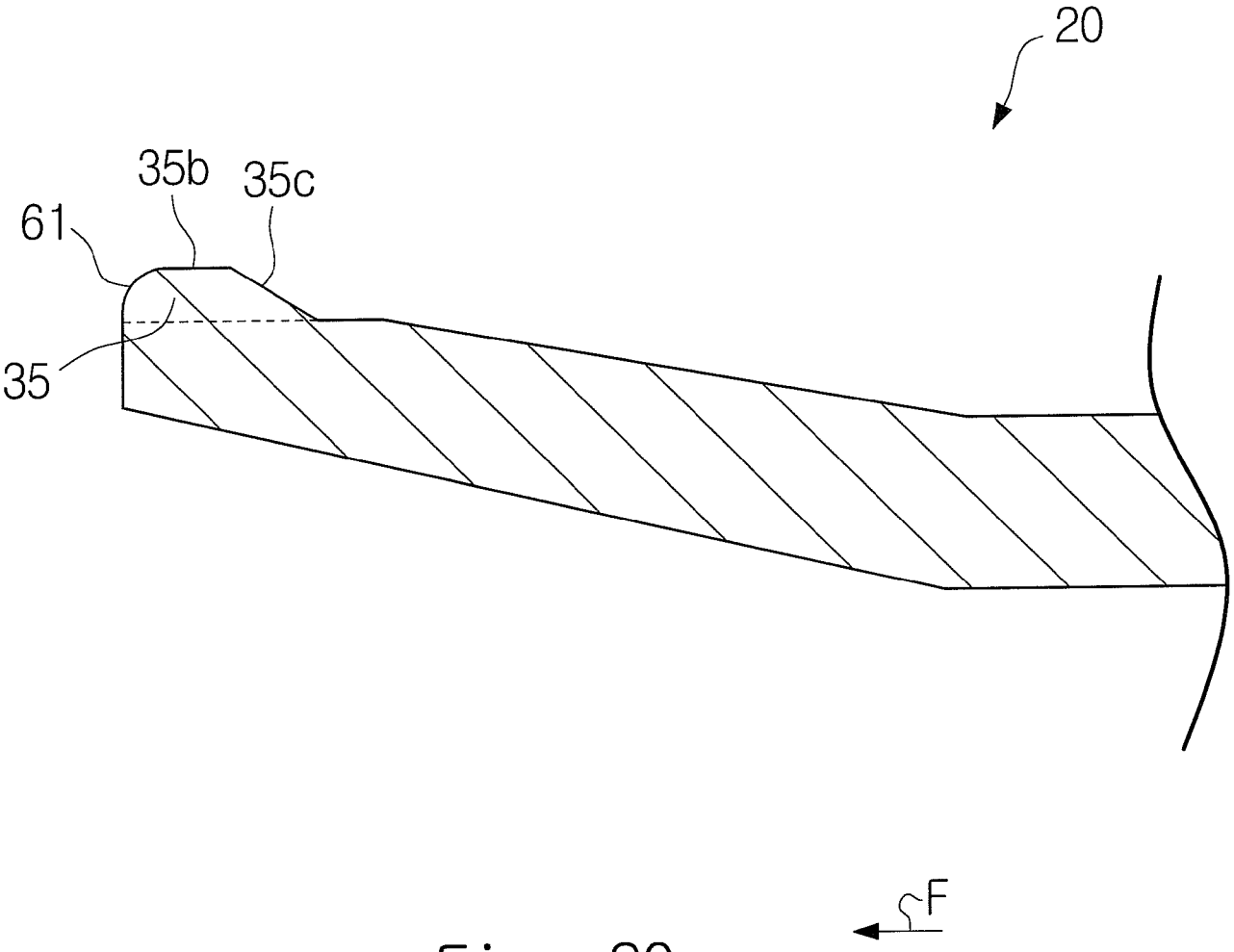
FIG. 20 is a cross-sectional side view of a lance (third exemplary embodiment)

Next, a third exemplary embodiment of the present invention will be described with reference to FIG. 20. In this description, only the difference from the first exemplary embodiment will be mainly described, and the overlapping description will be omitted as appropriate. Further, in principle, the components corresponding to those in the first exemplary embodiment are denoted by the same reference symbols.

The second engaging part 35 includes the second engaging part front end inclined surface 35*a* as shown in FIG. 11 in the first exemplary embodiment. Alternatively, the second engaging part 35 may include a second engaging part front end R surface 61 which is a curved surface as shown in FIG. 20. With the second engaging part front end R surface 61, the second engaging part 35 is further hardly damaged when the second engaging part 35 contacts with the second engaged part 24 of the female contact 9 compared to the first exemplary embodiment.

Fourth Exemplary Embodiment

Figure 21:
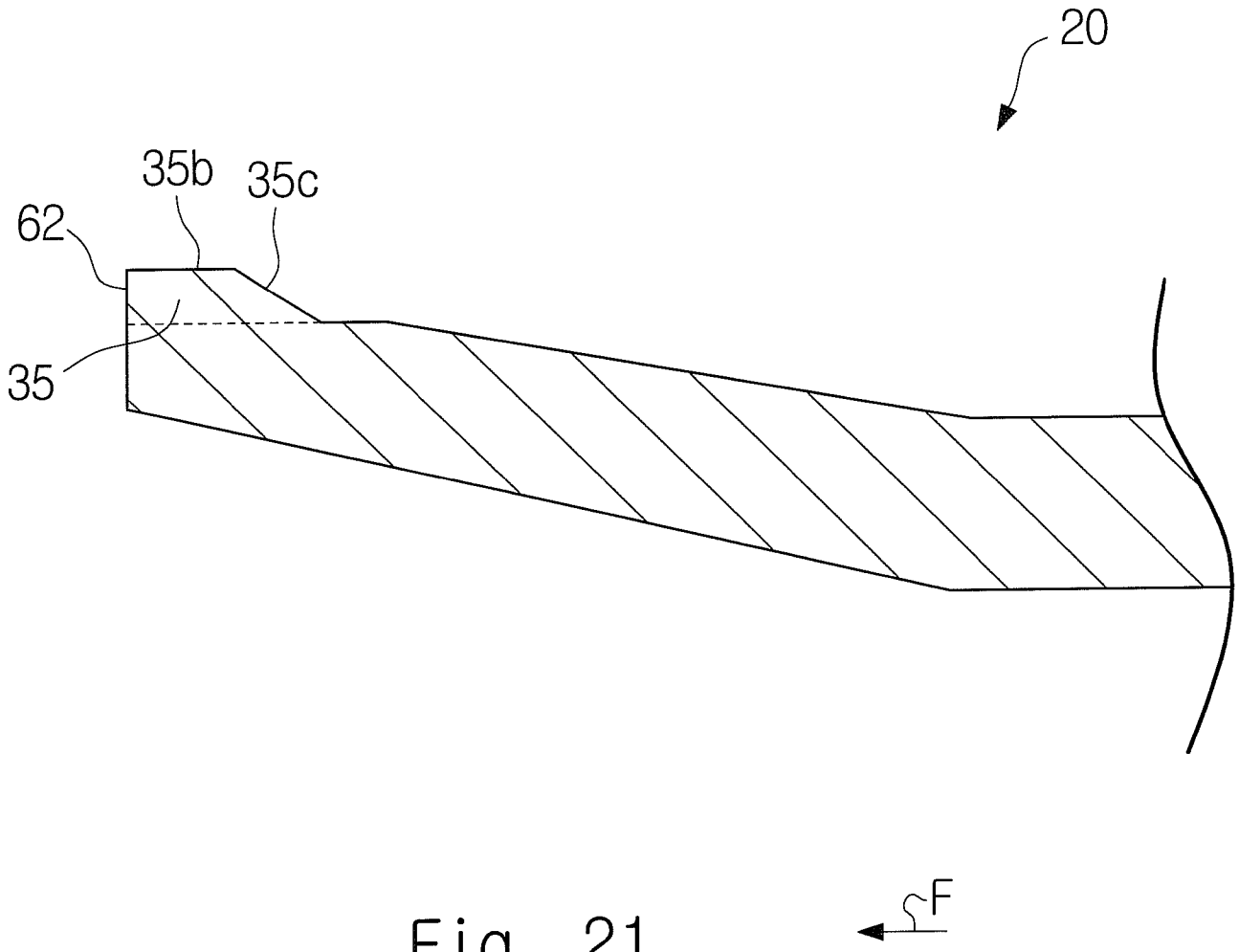
FIG. 21 is a cross-sectional side view of a lance (fourth exemplary embodiment)
Figure 22:
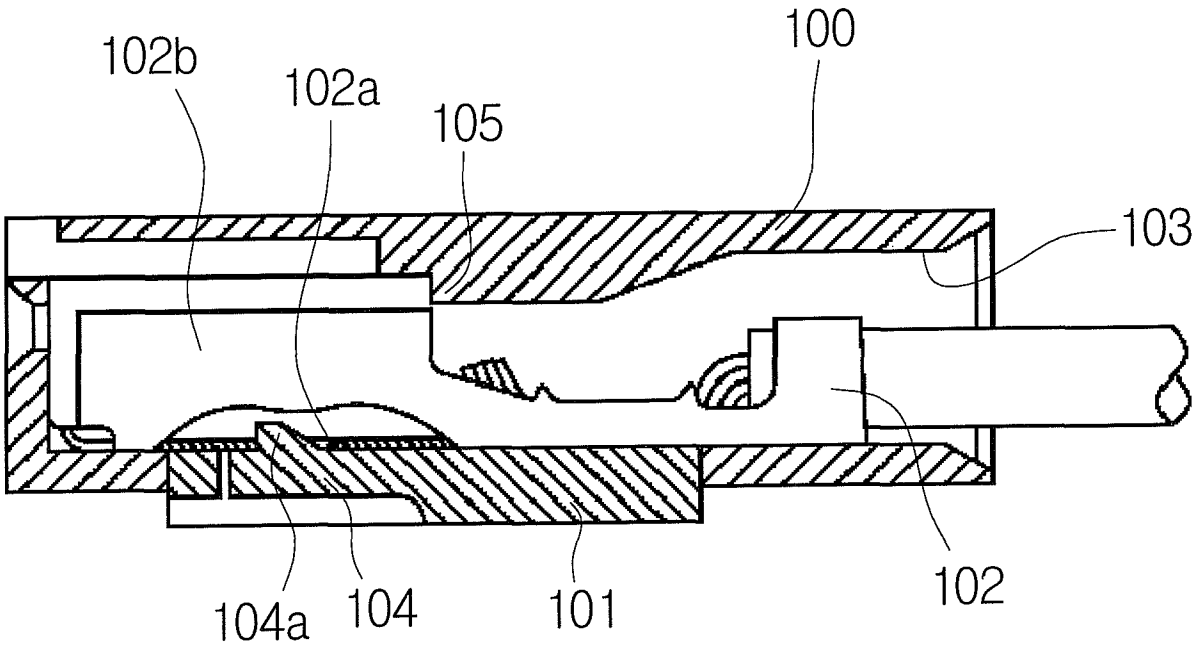
FIG. 22 is a view corresponding to FIG. 6 of Japanese Patent Application Publication No. 2000-268915.
Figure 23:
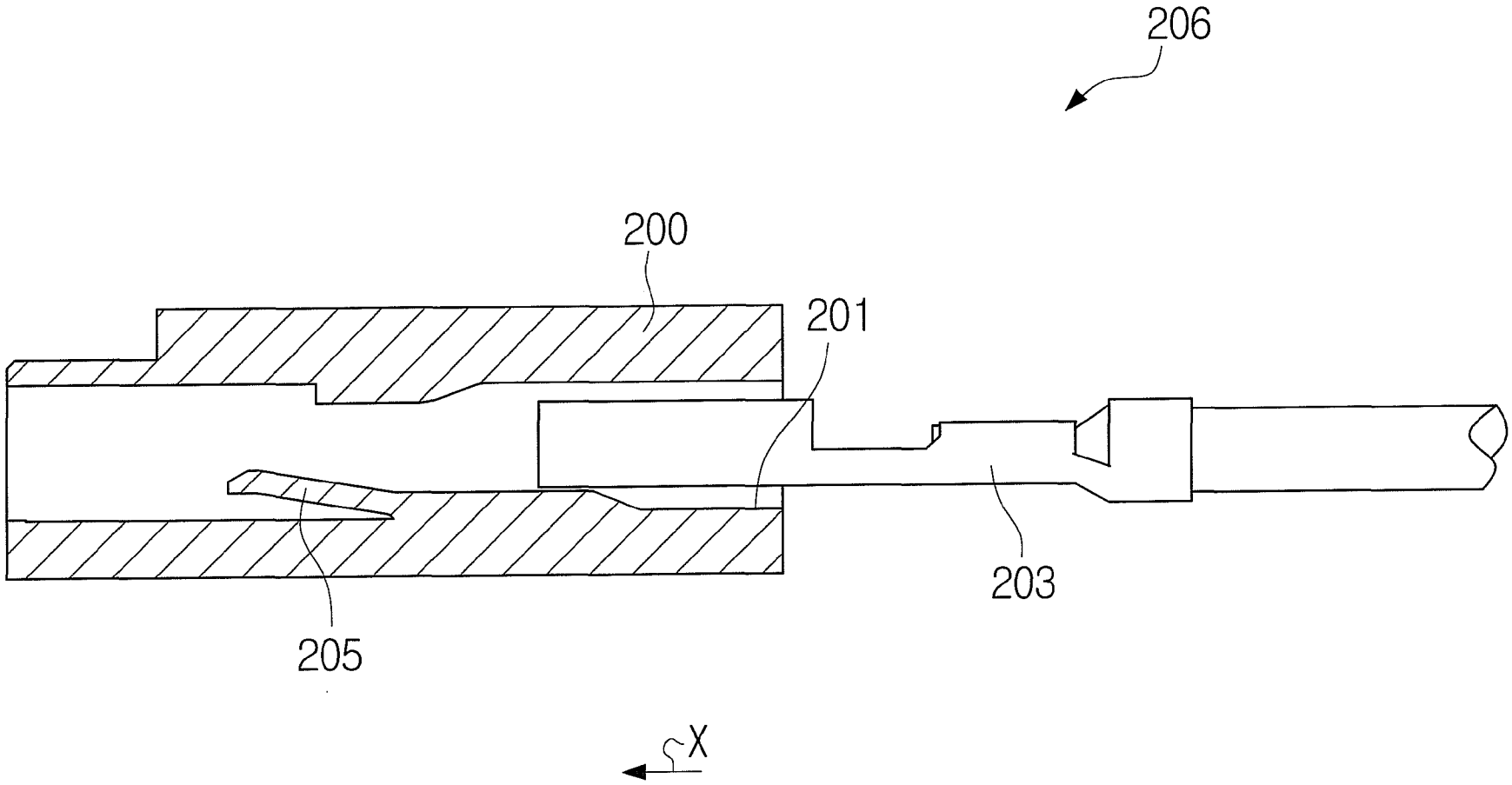
FIG. 23 is a first cross-sectional view showing a state in which a contact is inserted into a housing (comparative example)
Figure 24:
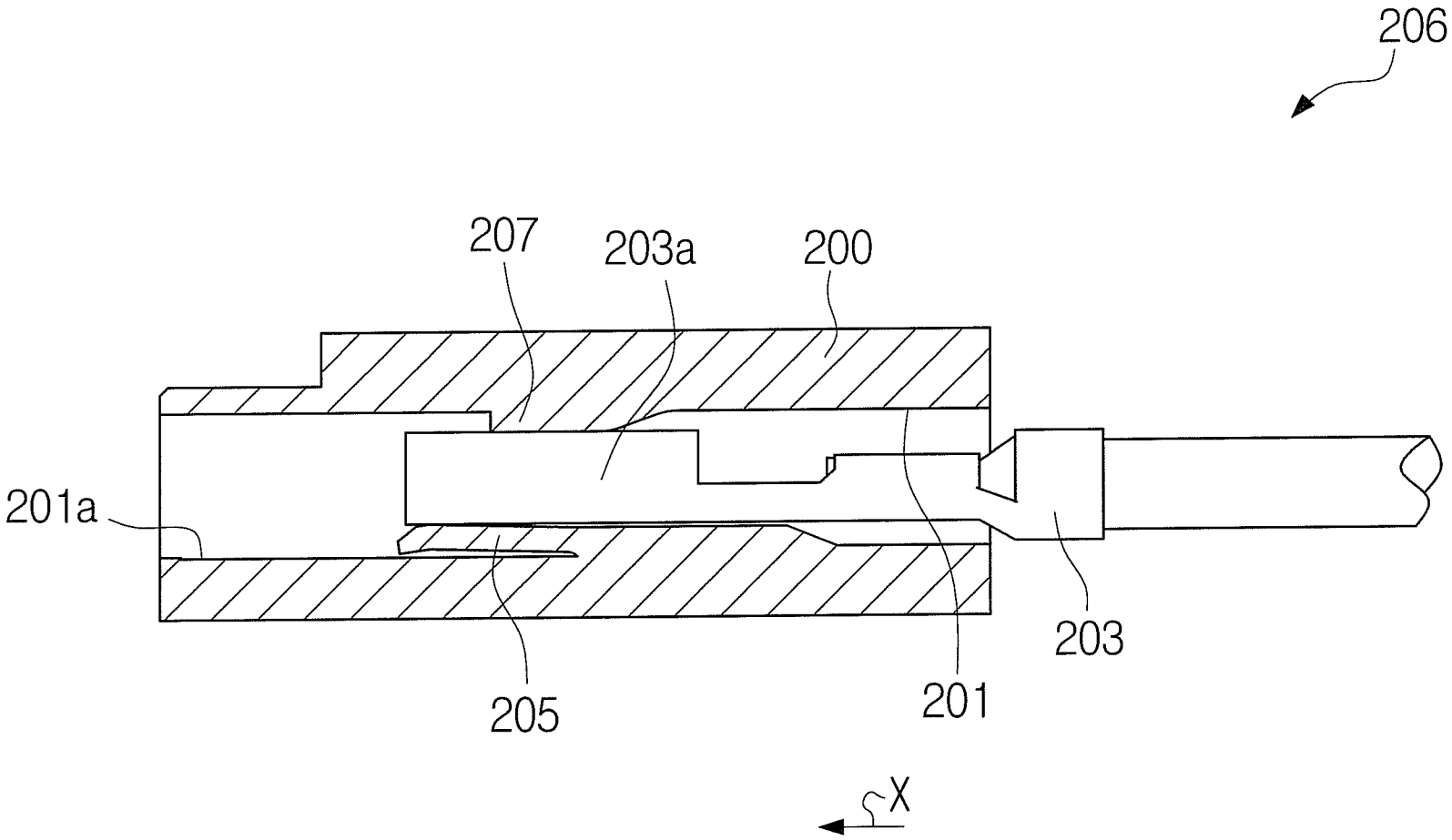
FIG. 24 is a second cross-sectional view showing a state in which the contact is inserted into the housing (comparative example)
Figure 25:
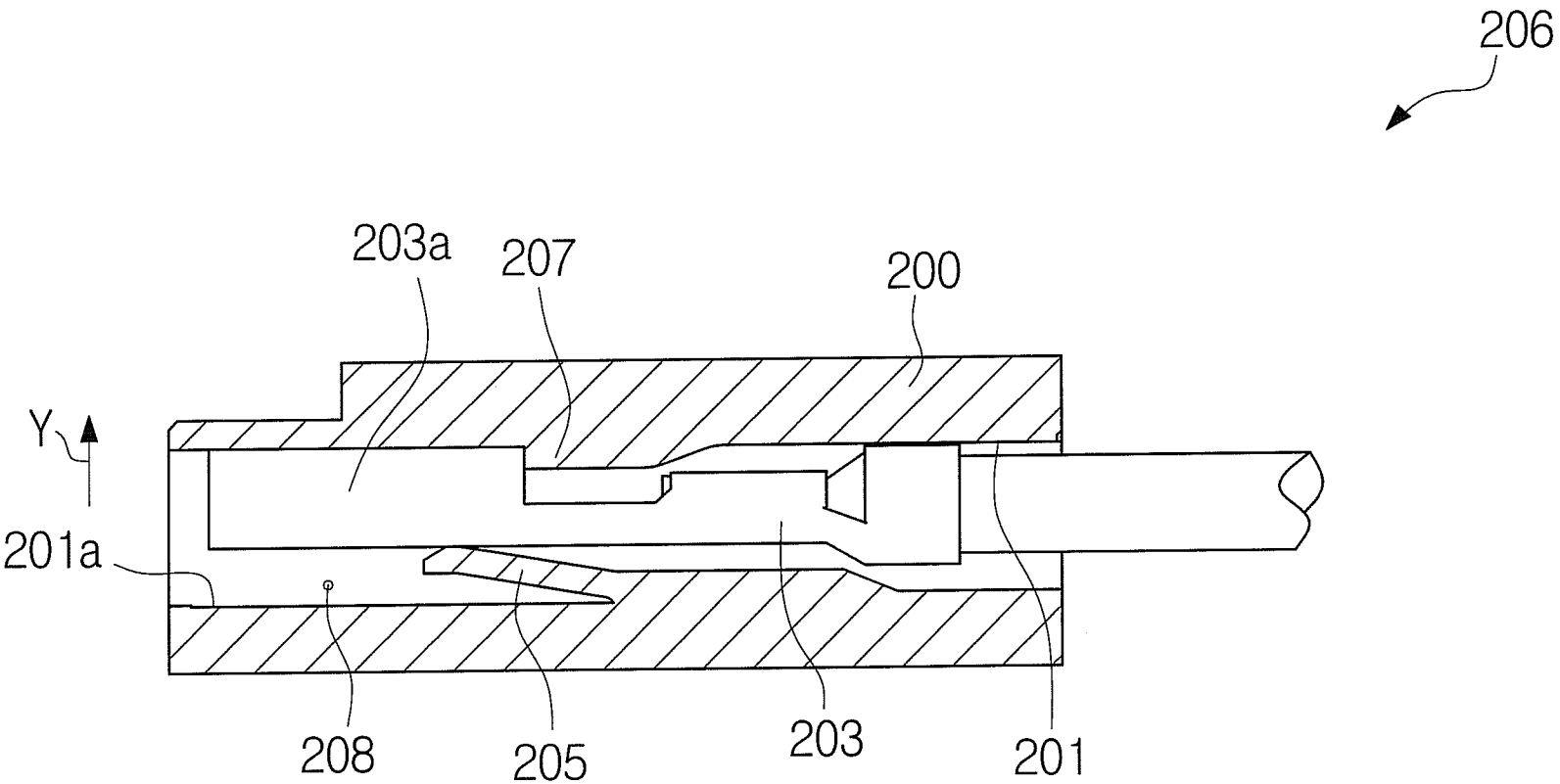
FIG. 25 is a cross-sectional view showing a primary locked state (comparative example)
Figure 26:
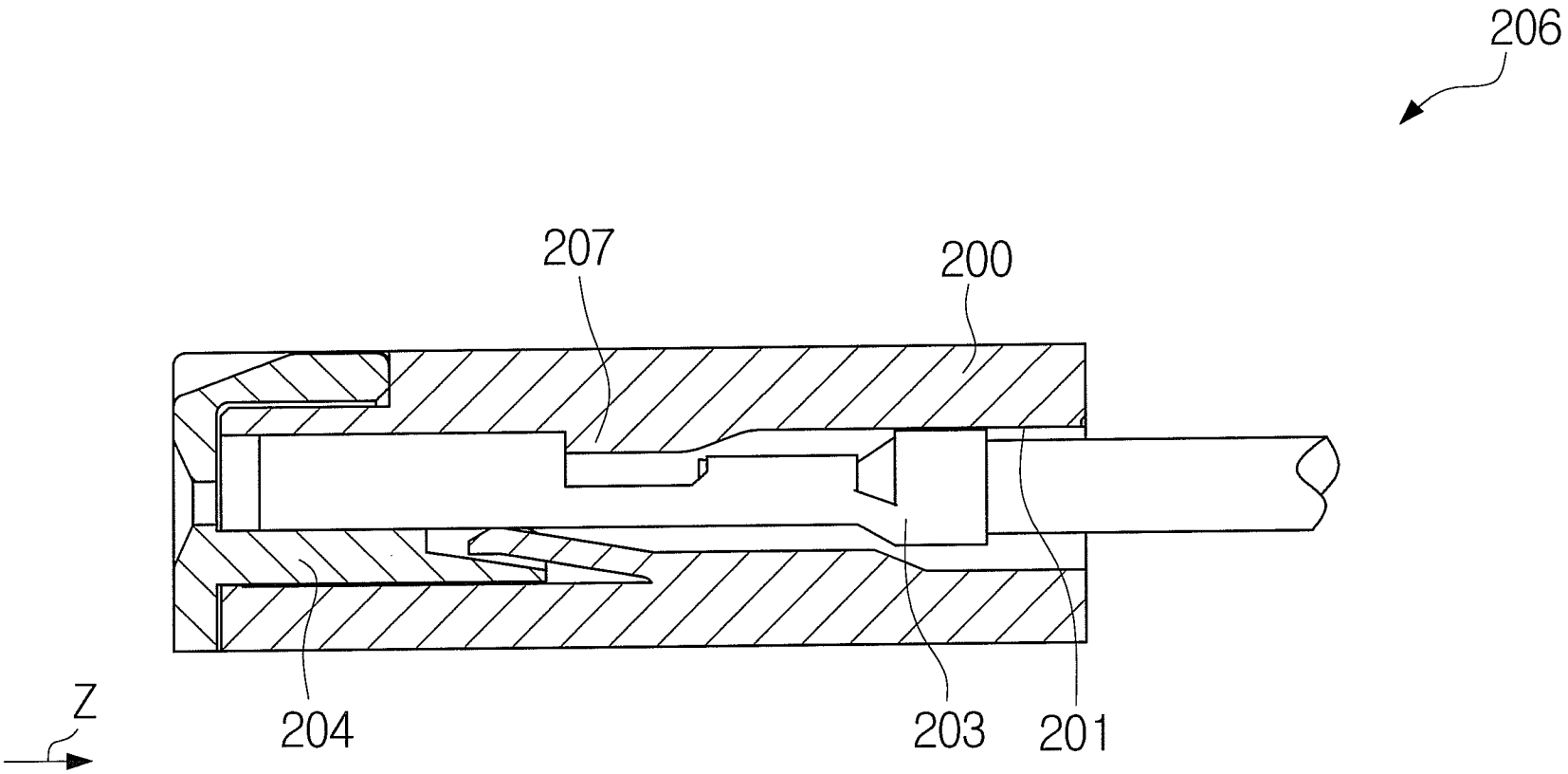
FIG. 26 is a cross-sectional view showing a secondary locked state (comparative example)
Figure 27:
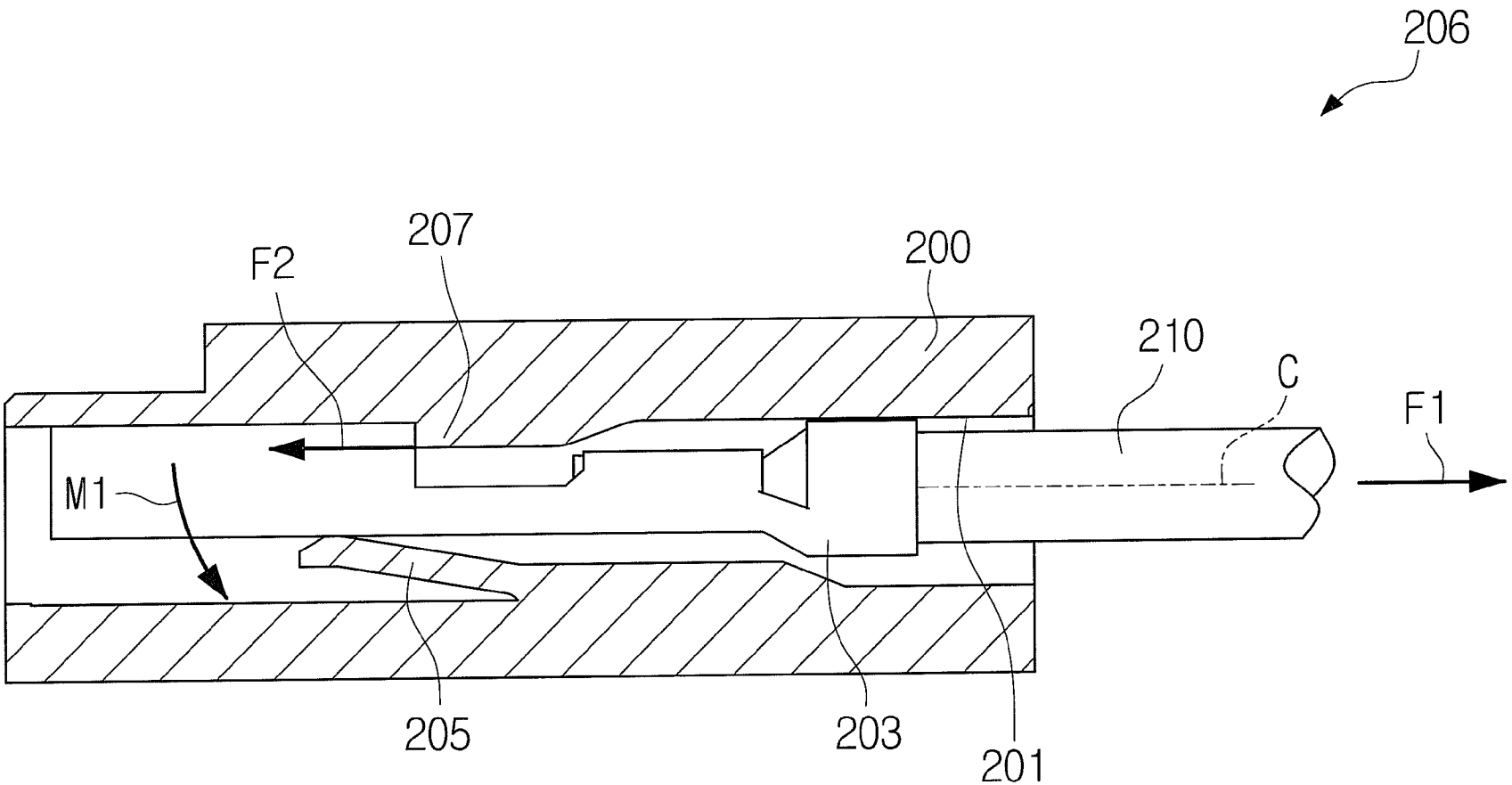
FIG. 27 is a first view for describing a problem in the comparative example (comparative example)
Figure 28:
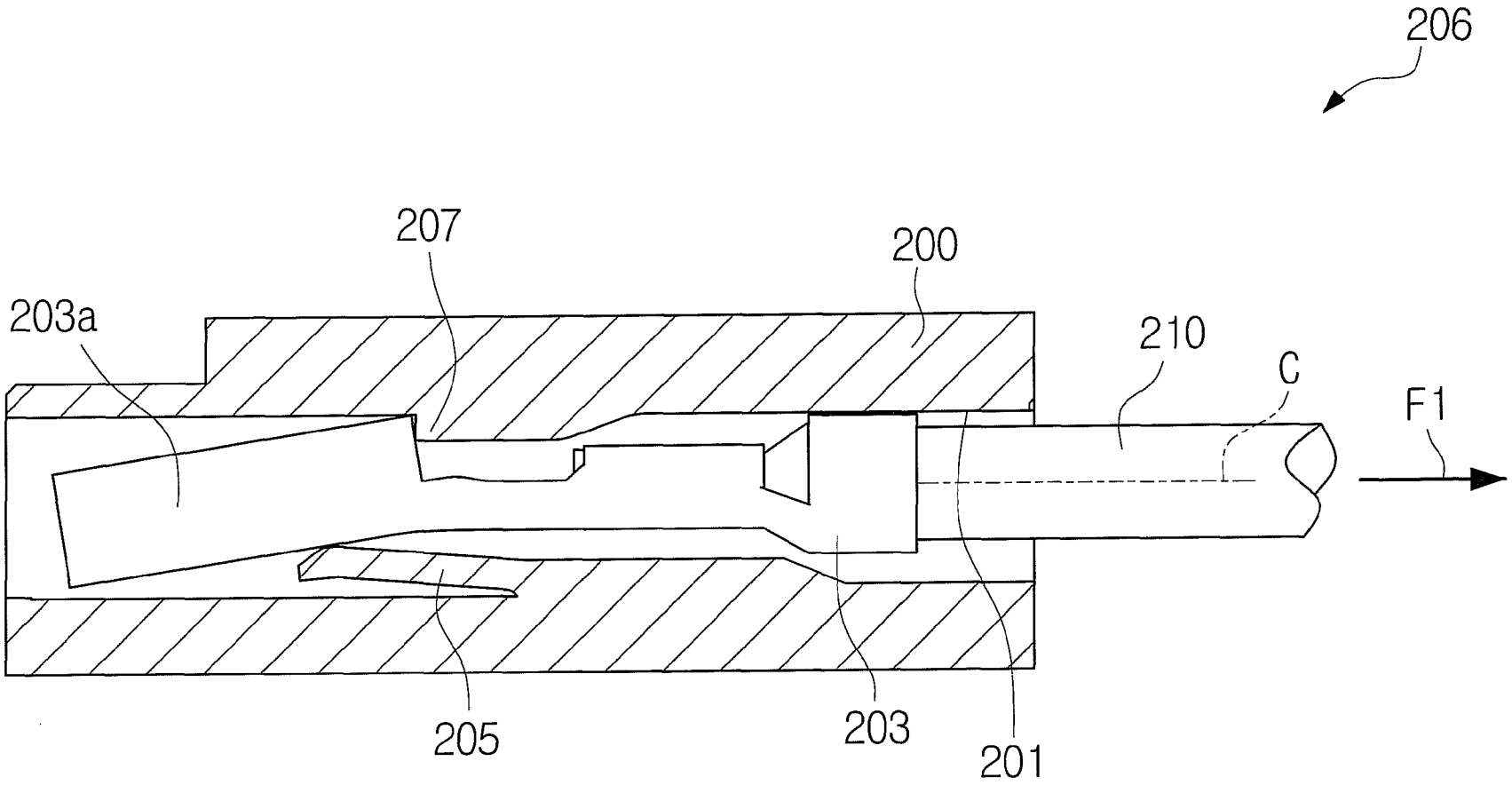
FIG. 28 is a second view for describing a problem in the comparative example (comparative example).

Next, a fourth exemplary embodiment of the present invention will be described with reference to FIG. 21. In this description, only the difference from the first exemplary embodiment will be mainly described, and the overlapping description will be omitted as appropriate. Further, in principle, the components corresponding to those in the first exemplary embodiment are denoted by the same reference symbols.

In the first exemplary embodiment, as shown in FIG. 11, the second engaging part 35 includes the second engaging part front end inclined surface 35*a*. Alternatively, as shown in FIG. 21, the second engaging part 35 may include a second engaging part front end perpendicular surface 62 that is perpendicular to the contact insertion direction F. With the second engaging part front end perpendicular surface 62, engagement force of the second engagement K shown in FIG. 16 becomes further strong compared to the first exemplary embodiment.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An electrical connector comprising:

a contact; and a housing having a cavity into which the contact is able to be inserted, wherein the housing comprises:

a first inner wall surface that defines the cavity and is substantially parallel to a contact insertion direction which is a direction in which the contact is inserted into the cavity;

a second inner wall surface that is opposed to the first inner wall surface;

a first engaging part that is formed to protrude from the first inner wall surface toward the second inner wall surface; and a pressing piece that is formed in the second inner wall surface and presses the contact inserted into the cavity toward the first inner wall surface, the contact comprises:

a pressed surface that is pressed by the pressing piece; and a first engaged part that is formed to protrude in a direction away from the pressed surface, when the contact is inserted into the cavity and the first engaged part moves beyond the first engaging part, the contact moves toward the first inner wall surface due to pressing force by the pressing piece, and a primary locked state is achieved in which the first engaged part is engaged with the first engaging part, and a second engaging part is formed in the housing and a second engaged part that is capable of being engaged with the second engaging part is formed in the contact so that a second engagement between the housing and the contact is achieved on a side opposite to the side of a first engagement between the first engaging part and the first engaged part with respect to a central axis of the contact.

2. The electrical connector according to claim 1, wherein the second engaging part is formed in the pressing piece.

3. The electrical connector according to claim 1, wherein the second engaged part is formed by forming a hole on the pressed surface or making a recess on the pressed surface.

4. The electrical connector according to claim 1, wherein the second engagement is performed in a near side of the contact insertion direction compared with the first engagement.

5. The electrical connector according to claim 1, wherein the pressing piece is formed in a cantilevered shape while being supported by the second inner wall surface, the second engaging part is formed in a free end of the pressing piece, and an abutted part that contacts with the pressed surface of the contact in the primary locked state is formed between the free end and a fixed end of the pressing piece.

6. The electrical connector according to claim 5, wherein an inclined surface is formed on a second engaged surface of the second engaged part with respect to the second engaging part, the inclined surface inclining so as to be away from the second engaging part toward the second inner wall surface.

7. The electrical connector according to claim 6, wherein a second engaging part front end surface corresponding to the second engaged surface is formed in the second engaging part.

8. The electrical connector according to claim 1, further comprising a retainer that prevents movement of the contact inserted into the cavity in a direction perpendicular to the contact insertion direction, wherein by inserting the retainer between the contact and the second inner wall surface in the primary locked state, a secondary locked state is achieved in which the movement of the contact in the direction perpendicular to the contact insertion direction is prevented.

9. A harness comprising:

an electric wire comprising a core wire including the contact attached thereto; and an electrical connector comprising:

a contact; and a housing having a cavity into which the contact is able to be inserted, wherein the housing comprises:

a first inner wall surface that defines the cavity and is substantially parallel to a contact insertion direction which is a direction in which the contact is inserted into the cavity;

a second inner wall surface that is opposed to the first inner wall surface;

a first engaging part that is formed to protrude from the first inner wall surface toward the second inner wall surface; and a pressing piece that is formed in the second inner wall surface and presses the contact inserted into the cavity toward the first inner wall surface, the contact comprises:

a pressed surface that is pressed by the pressing piece; and a first engaged part that is formed to protrude in a direction away from the pressed surface, when the contact is inserted into the cavity and the first engaged part moves beyond the first engaging part, the contact moves toward the first inner wall surface due to pressing force by the pressing piece, and a primary locked state is achieved in which the first engaged part is engaged with the first engaging part, and a second engaging part is formed in the housing and a second engaged part that is capable of being engaged with the second engaging part is formed in the contact so that a second engagement between the housing and the contact is achieved on a side opposite to the side of a first engagement between the first engaging part and the first engaged part with respect to a central axis of the contact.

* * * * *